US012781459B2

(12) United States Patent
Prass et al.

(10) Patent No.: US 12,781,459 B2
(45) Date of Patent: Nov. 3, 2026

(54) FOUNDATION FOR A TOWER OF A TRANSMITTING STATION OR FOR OVERHEAD-LINE CONSTRUCTION

(71) Applicant: ANKER FOUNDATIONS GMBH, Lichtenfels (DE)

(72) Inventors: Gregor Prass, Hamburg (DE); Christoph Schriefer, Redefin (DE)

(73) Assignee: Next Foundation GmbH, Hamburg (DE)

( * ) Notice: Subject to any disclaimer, the term of this patent is extended or adjusted under 35 U.S.C. 154(b) by 535 days.

(21) Appl. No.: 18/038,012

(22) PCT Filed: Nov. 15, 2021

(86) PCT No.: PCT/EP2021/081745
§ 371 (c)(1),
(2) Date: Feb. 19, 2024

(87) PCT Pub. No.: WO2022/106371
PCT Pub. Date: May 27, 2022

(65) Prior Publication Data

US 2025/0297446 A1 Sep. 25, 2025

(30) Foreign Application Priority Data

Nov. 20, 2020 (DE) ..... 102020130813.2
Mar. 11, 2021 (DE) ..... 102021106003.6

(51) Int. Cl.
*E02D 27/42* (2006.01)
*E04H 12/22* (2006.01)

(52) U.S. Cl.
CPC ..... *E02D 27/42* (2013.01); *E04H 12/2261* (2013.01)

(58) Field of Classification Search
CPC ..... E02D 27/42; E02D 27/425; E02D 27/016; E04H 12/2261; F03D 13/206
See application file for complete search history.

(56) References Cited

U.S. PATENT DOCUMENTS 2,057,018 A * 10/1936 Dillon ..... E04H 17/165 52/297
8,898,991 B2 * 12/2014 Cai ..... F03D 13/10 52/651.01

(Continued)

FOREIGN PATENT DOCUMENTS

DE 202015003668 U1 11/2015
DE 102018121024 A1 3/2020
WO 1995002094 A1 1/1995

*Primary Examiner* — Gisele D Ford
(74) *Attorney, Agent, or Firm* — Mark Rodgers

(57) ABSTRACT

The invention relates to a foundation for a tower of a transmitting station or for overhead-line construction, the foundation comprising at least three prefabricated elements made from reinforced concrete and a mounting region for erecting the tower, at least one first and at least one second prefabricated element forming a lower first portion which is in contact with the ground at the erection site of the foundation, and at least one third prefabricated element forming an upper portion that is located on said first portion, the mounting region comprising at least one fastening point for positioning the tower on the foundation, said fastening point being provided on an upper side of the upper portion. Advantageously: the at least one first prefabricated element and the at least one second prefabricated element of the lower portion are positioned substantially parallel to and spaced apart from one another so that there is a distance between the at least two prefabricated elements; at least one third prefabricated element of the upper portion is positioned on the at least one first prefabricated element and on the at least one second prefabricated element so that the at least (Continued)

Figure 1:
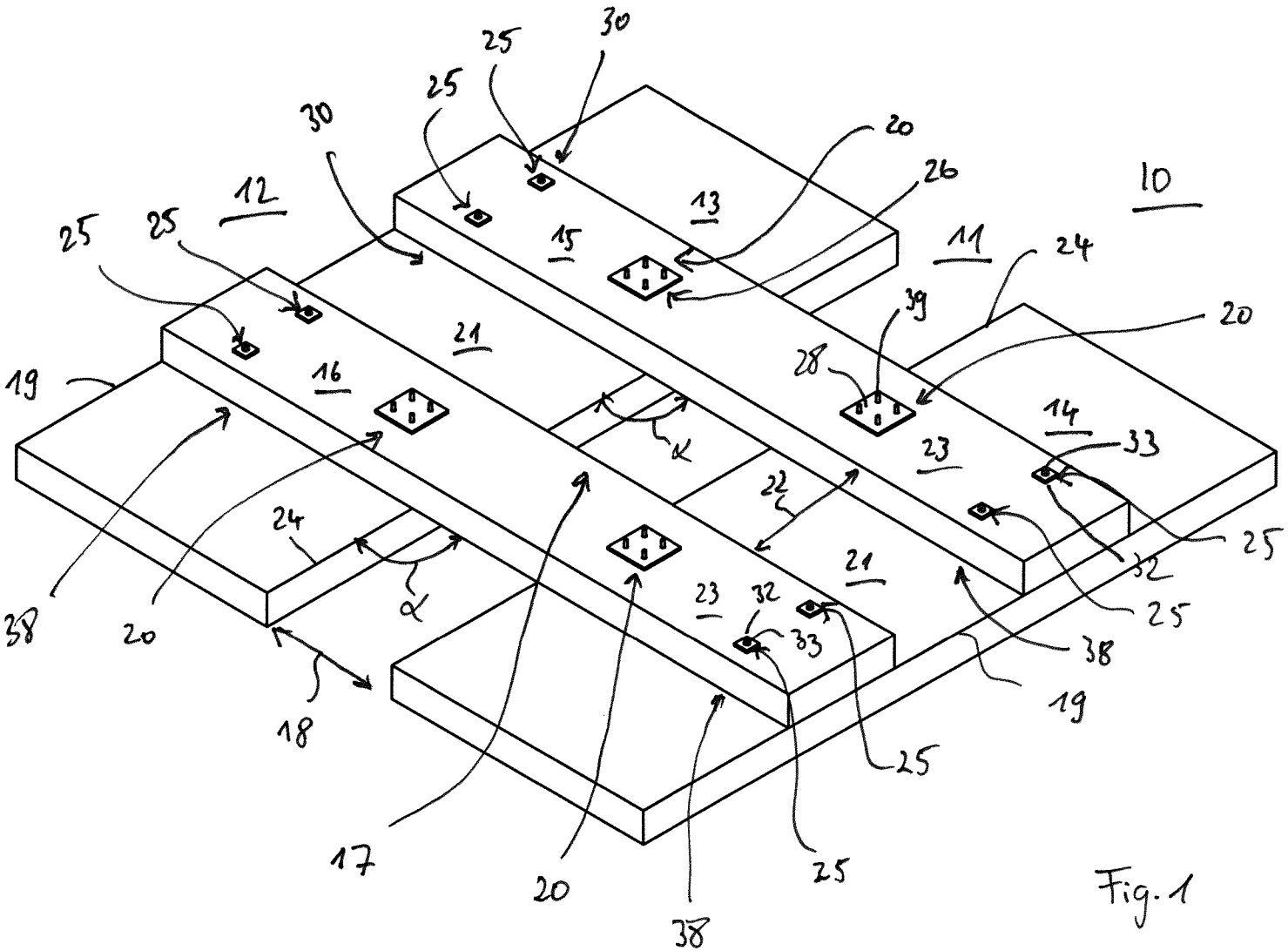

one third prefabricated element bridges the distance; and the at least one third prefabricated element has a maximum length so that the at least one third prefabricated element is substantially flush on both sides with the outer edge of the at least one first prefabricated element and the at least one second prefabricated element.

12 Claims, 28 Drawing Sheets

(56) References Cited

U.S. PATENT DOCUMENTS

| | | | | |
|---|---|---|---|---|
| 2012/0167499 | A1* | 7/2012 | Knisel | F03D 13/22 52/231 |
| 2012/0201609 | A1* | 8/2012 | Foote | E02D 27/42 405/195.1 |
| 2021/0087773 | A1* | 3/2021 | Lim | E02D 27/01 |

* cited by examiner

FOUNDATION FOR A TOWER OF A TRANSMITTING STATION OR FOR OVERHEAD-LINE CONSTRUCTION

The invention relates to a foundation for a tower for a transmission system or for overhead line construction, the foundation having at least three prefabricated elements made of reinforced concrete and an assembly area for erecting the tower, with at least a first and at least a second prefabricated element having a lower first section in contact with a ground at the site of erection of the foundation, and wherein at least a third prefabricated element forms an upper section arranged on the first section, wherein the mounting area has at least one attachment point for arranging the tower on the foundation, which is on an upper side of the upper section is provided Foundations for towers of transmitters, especially for mobile communications, for overhead line construction are essentially designed as in-situ concrete foundations. For this purpose, a pit is dug at the construction site, which is provided with a blinding layer. The formwork and reinforcement are then erected and the whole thing filled with concrete on site. A flat body is possibly erected with a base. In addition to the transport costs for the delivery of the concrete, the formwork and the reinforcement, this is very labour-intensive on site. Quality assurance is also complex or, depending on the weather, also problematic. In addition, while the in-situ concrete is curing (e.g. B. 28 days) a construction site can be set up. Furthermore, dismantling after the end of the service life is expensive and very complex.

A tower is understood here to mean both a tower made of pipe sections, for example made of concrete and/or steel, and also a truss tower/lattice tower/mast or a combination of both. The invention provides that the at least one first prefabricated element and the at least one second prefabricated element of the lower section are arranged essentially parallel and at a distance from one another, so that there is a distance between the at least two prefabricated elements that at least a third prefabricated element of the upper section is arranged on the at least one first prefabricated element and on the at least one second prefabricated element such that the at least one third prefabricated element bridges the distance and that the at least one third prefabricated element has a maximum length such that the at least one third prefabricated element terminates on both sides essentially flush with the outer edge of the at least one first prefabricated element and the at least one second prefabricated element.

This provides a particularly simple foundation. Surprisingly, it has been shown that such a foundation is sufficient to transfer the loads that occur into the ground. In particular, it is possible with the foundation according to the invention to build both three-legged towers, four-legged towers and multi-legged towers, but also round towers with the foundation according to the invention, at the same time enabling a larger connection geometry for these towers and still maintain transport capabilities even with larger diameters/connection geometries.

The at least three prefabricated elements are preferably designed in the form of plates or cuboids. In particular, it has surprisingly been shown that if cuboid or cuboid-like or slab-like, elongated prefabricated elements made of reinforced concrete are arranged as explained above, the loads can be transferred accordingly even with larger connection geometries.

Depending on the height and diameter of the tower, the dimensions of the prefabricated elements are preferably chosen such that the assembly area of the tower extends to the upper section of the foundation, which leads to a particularly simple and inexpensive foundation.

Prefabricated elements can, for example, be manufactured on site and then placed at the construction site or, for example, are manufactured in a concrete plant under defined conditions and then transported to the construction site. Other variants are also possible.

The foundation is constructed in particular by providing a depression in the ground at the construction site, for example in the form of trenches or an excavation pit, possibly with a blinding layer, in which the first section of the foundation is then deposited. To increase the load on the foundation or its parts, it can be covered with soil.

It is also advantageous that the at least one fastening point of the assembly area has at least one breakthrough with a vertical extension through at least one prefabricated element for inserting at least one fastening element, with the fastening elements preferably being an anchor cage, vertical bracing elements, prestressing elements, reinforcement elements or anchor elements, preferably threaded rods. The openings are preferably provided in all or at least in all but the lowest prefabricated element in the assembly area. It is advantageous for the openings in the prefabricated elements to be aligned in order to accommodate the fastening elements. These are used to brace/prestress the foundation parts and/or to fasten the tower.

A further teaching of the invention provides that at least one connection point has for connecting the upper section to the lower section, and that the at least one connection point has an opening with a vertical extension through at least one prefabricated element for inserting at least one fastening element, which is preferred the fastening elements are an anchor cage, vertical bracing elements, prestressing elements, reinforcement elements or anchor elements, preferably threaded rods.

The openings are preferably provided in all or at least in all but the bottom prefabricated element. It is advantageous for the openings in the prefabricated elements to be aligned in order to accommodate the fastening elements. These are used to brace/prestress the foundation parts and/or to fasten the tower. It is advantageous here that the fastening elements are used to provide a prestress in an element joint between at least two prefabricated elements, so that there is preferably a shear connection in the element joint. In the case of prestressing, a shear connection is preferably provided by prestressing the prefabricated elements in one of the element joints. The load transfer takes place through the prestressing via friction in the element joint. As a result, the fasteners are free from shear loads.

Alternatively, it can be provided, particularly if the loads to be removed are lower, that the fastening elements are used to brace an element joint between at least two prefabricated ones, which is designed in such a way that a shear hole bearing connection is provided.

It is also advantageous that the at least one third prefabricated element has a width that is less than or equal to the width of the at least one first prefabricated element and/or the at least one second prefabricated element.

A further teaching of the invention provides that the at least one third prefabricated element is arranged essentially at right angles (a) to the at least one first element and/or to the at least one second element.

It is also advantageous that precisely one third prefabricated element is provided, or that precisely one third prefabricated element and precisely one fourth prefabricated element are provided, the third prefabricated element and the fourth prefabricated element preferably being arranged parallel and spaced apart from one another. As a result, a simple foundation can be provided, but with which the loads that occur can be optimally transferred.

Figure 2:
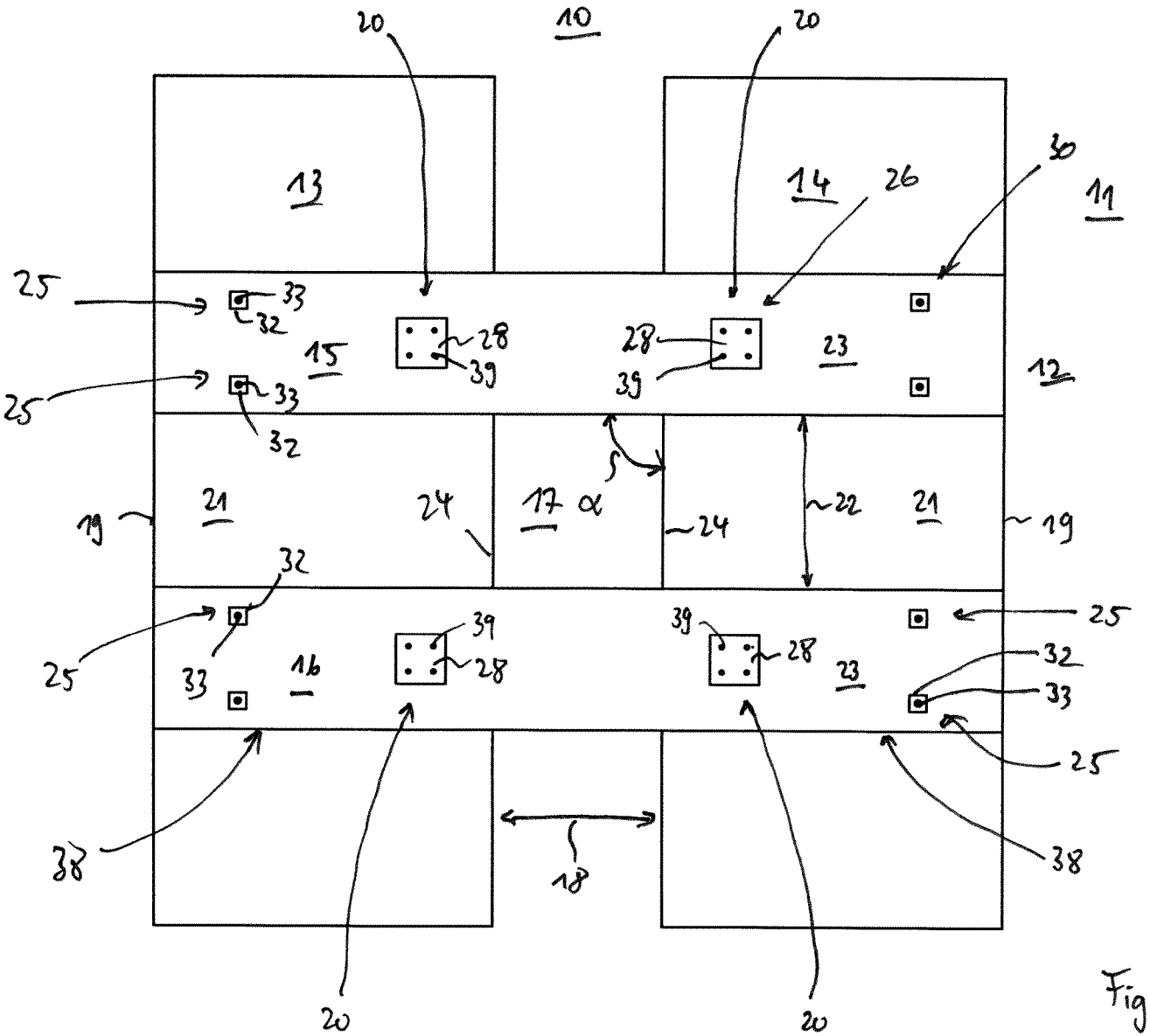
Figure 3A:
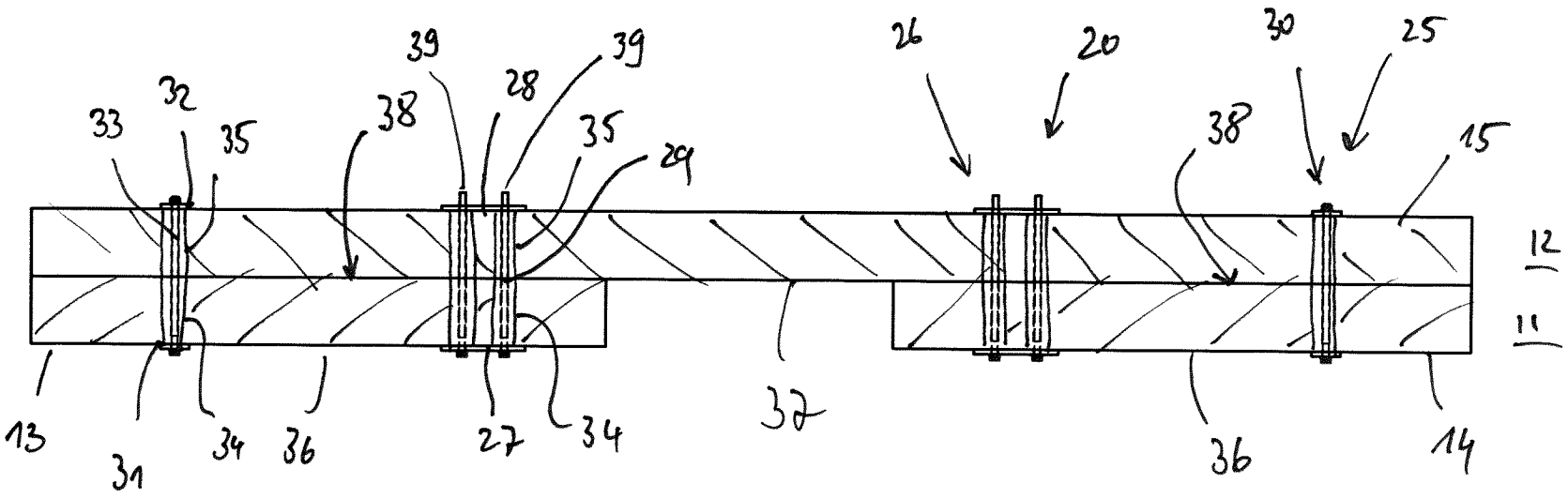
Figure 3B:
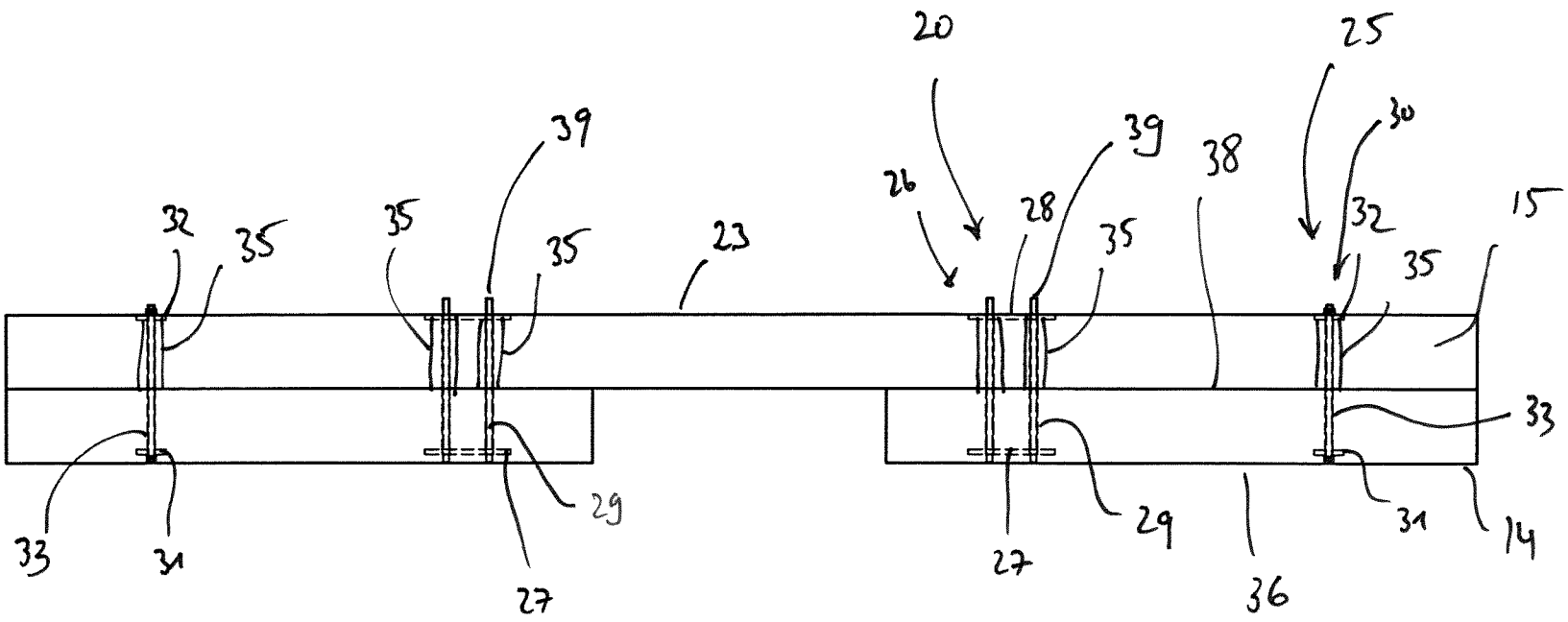
Figure 4A:
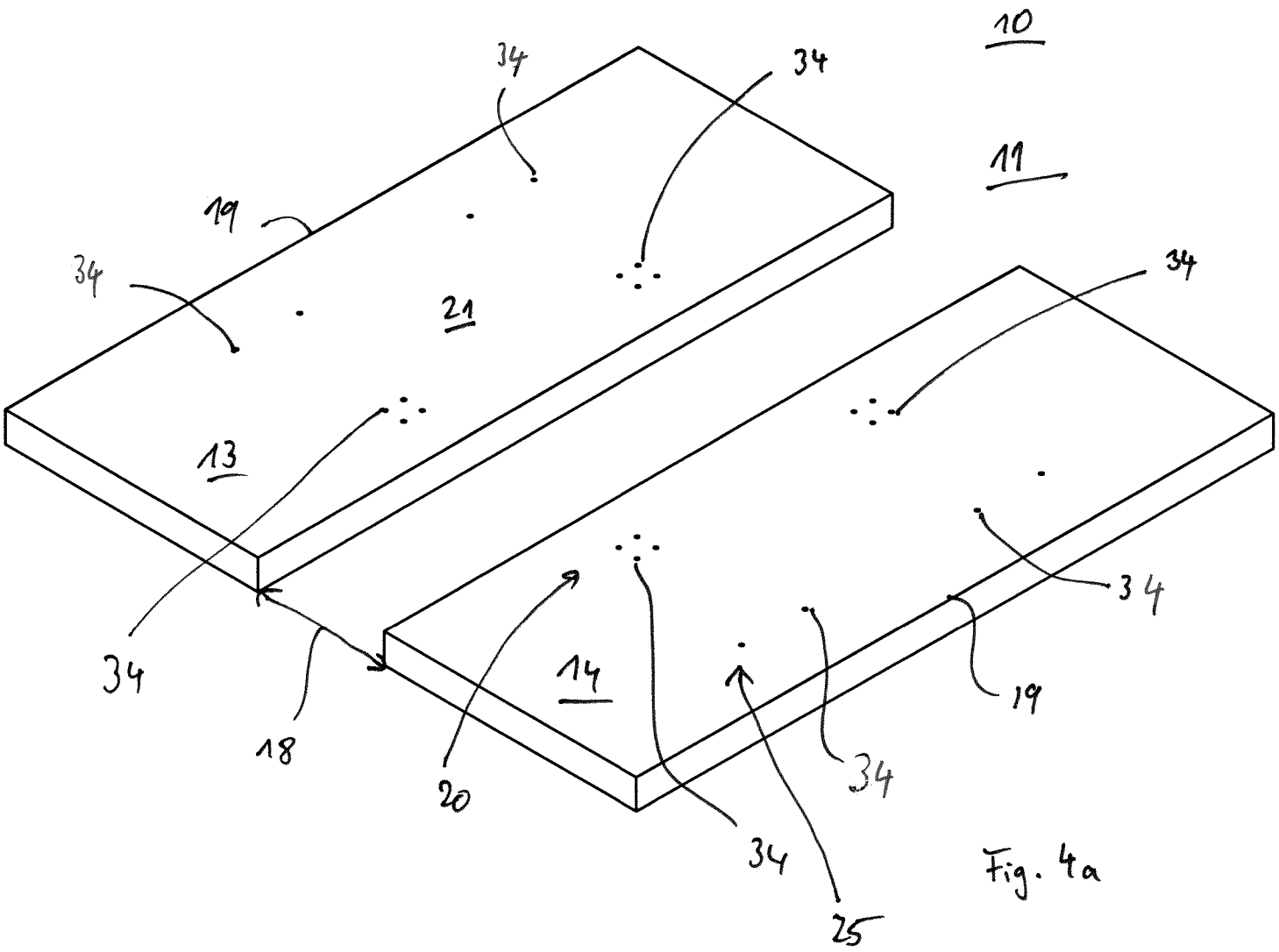
Figure 4B:
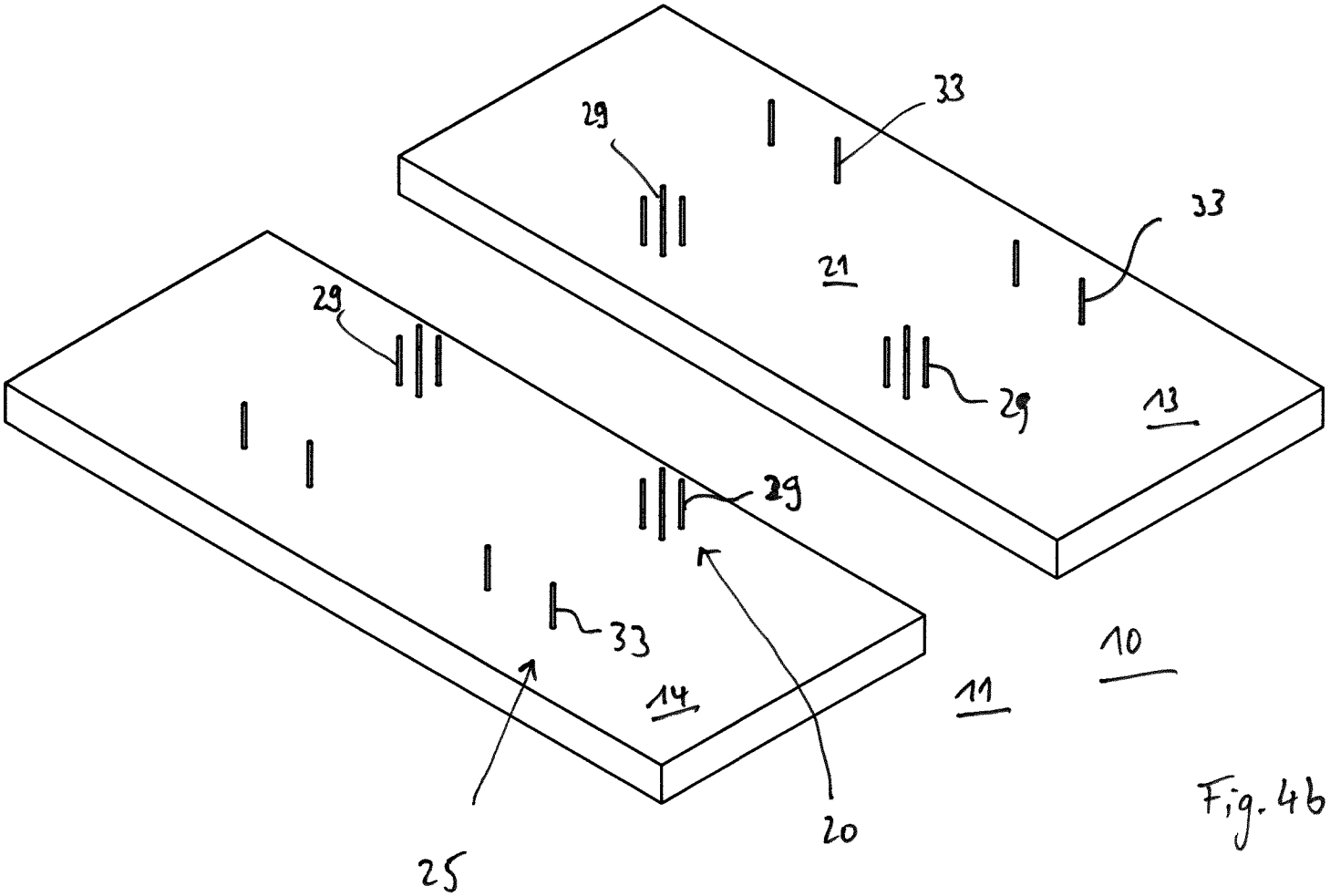
Figure 5A:
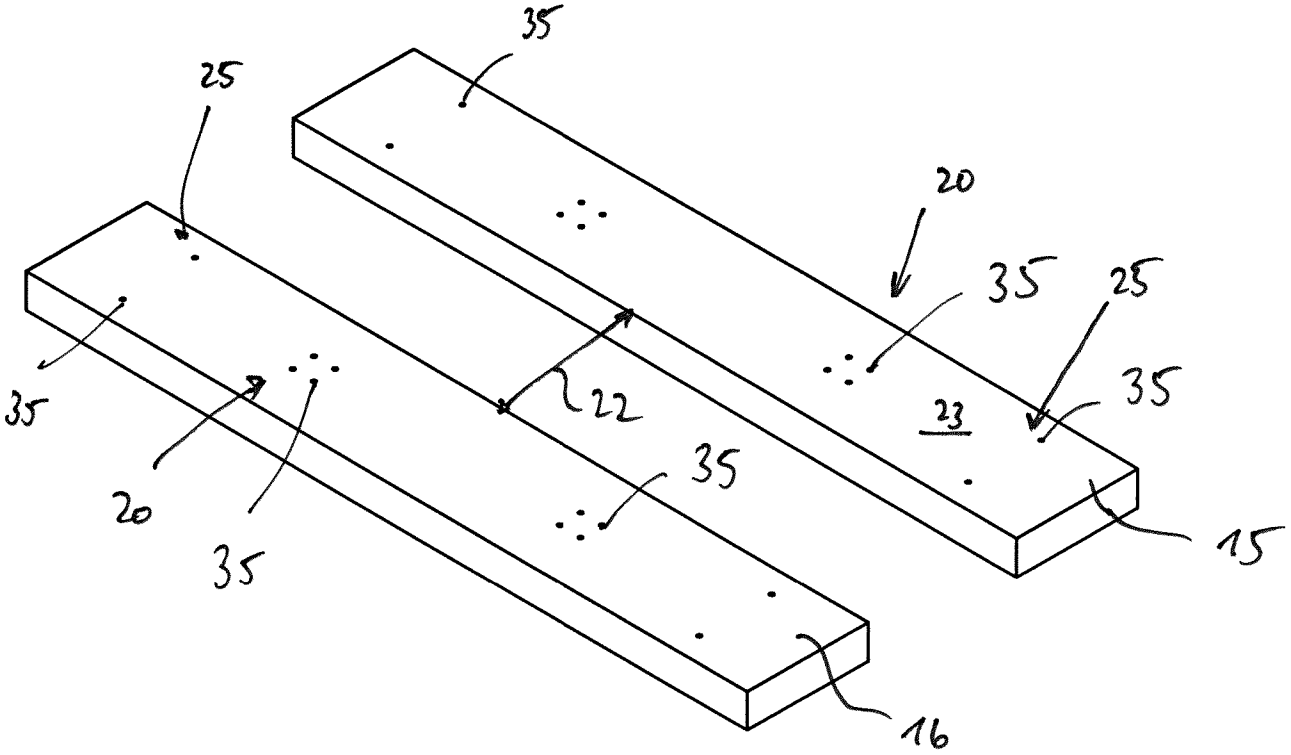
Figure 5B:
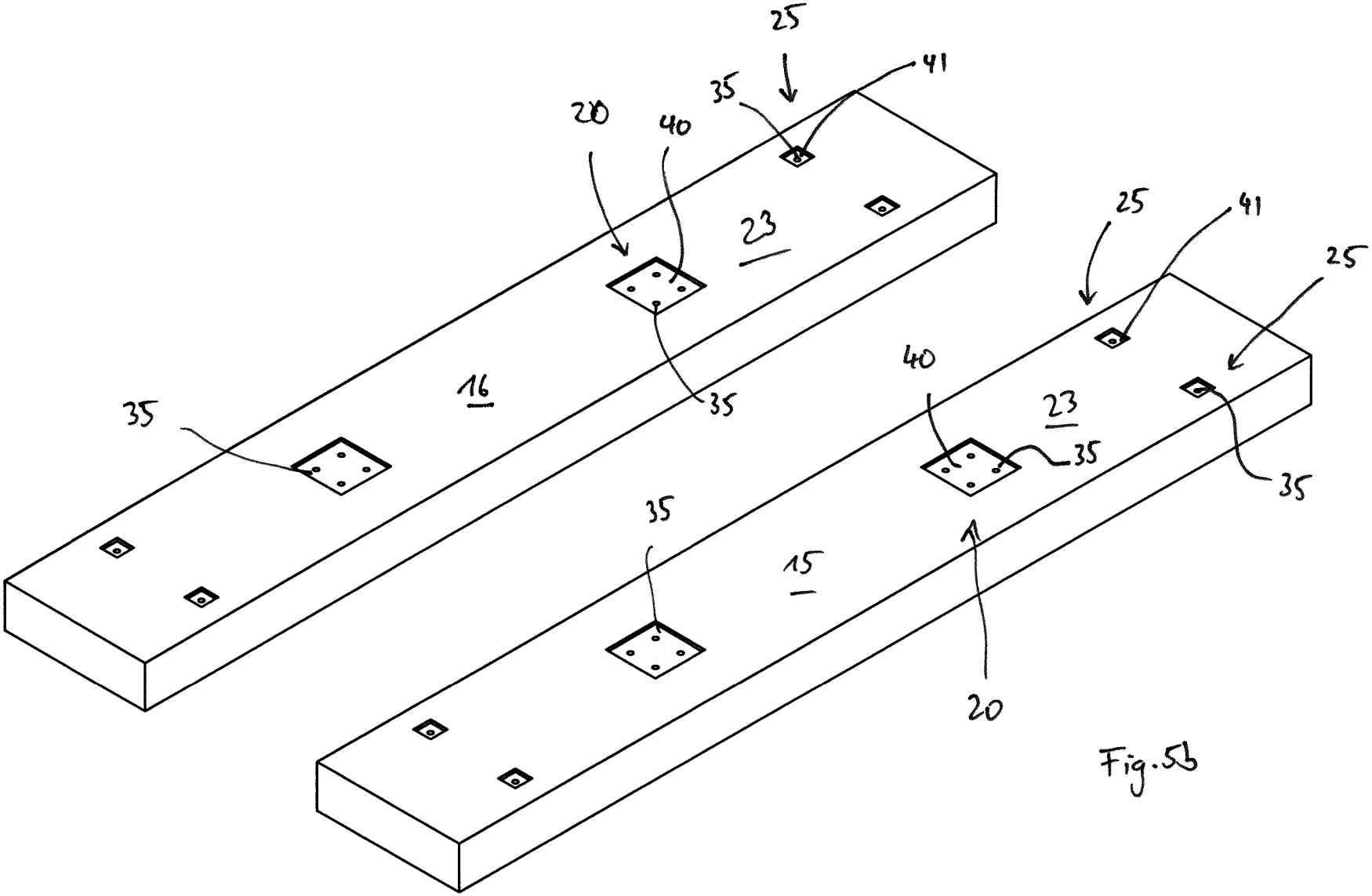
Figure 6:
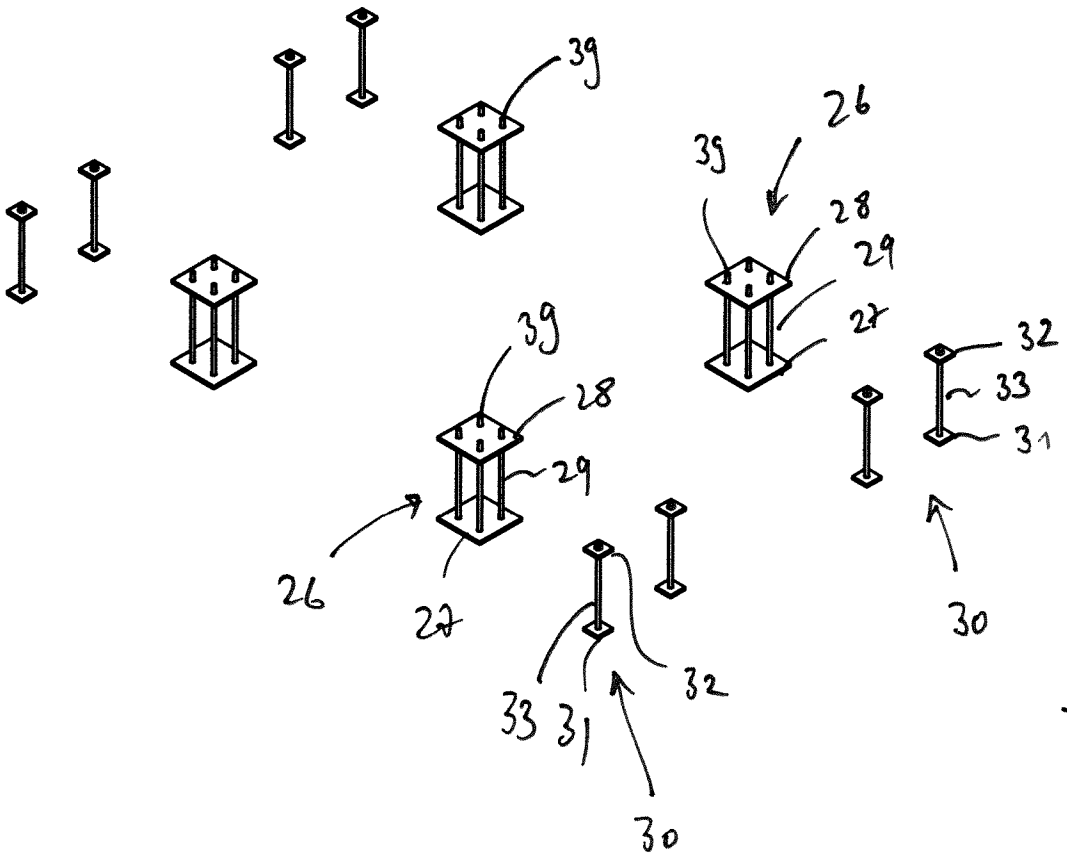
Figure 7:
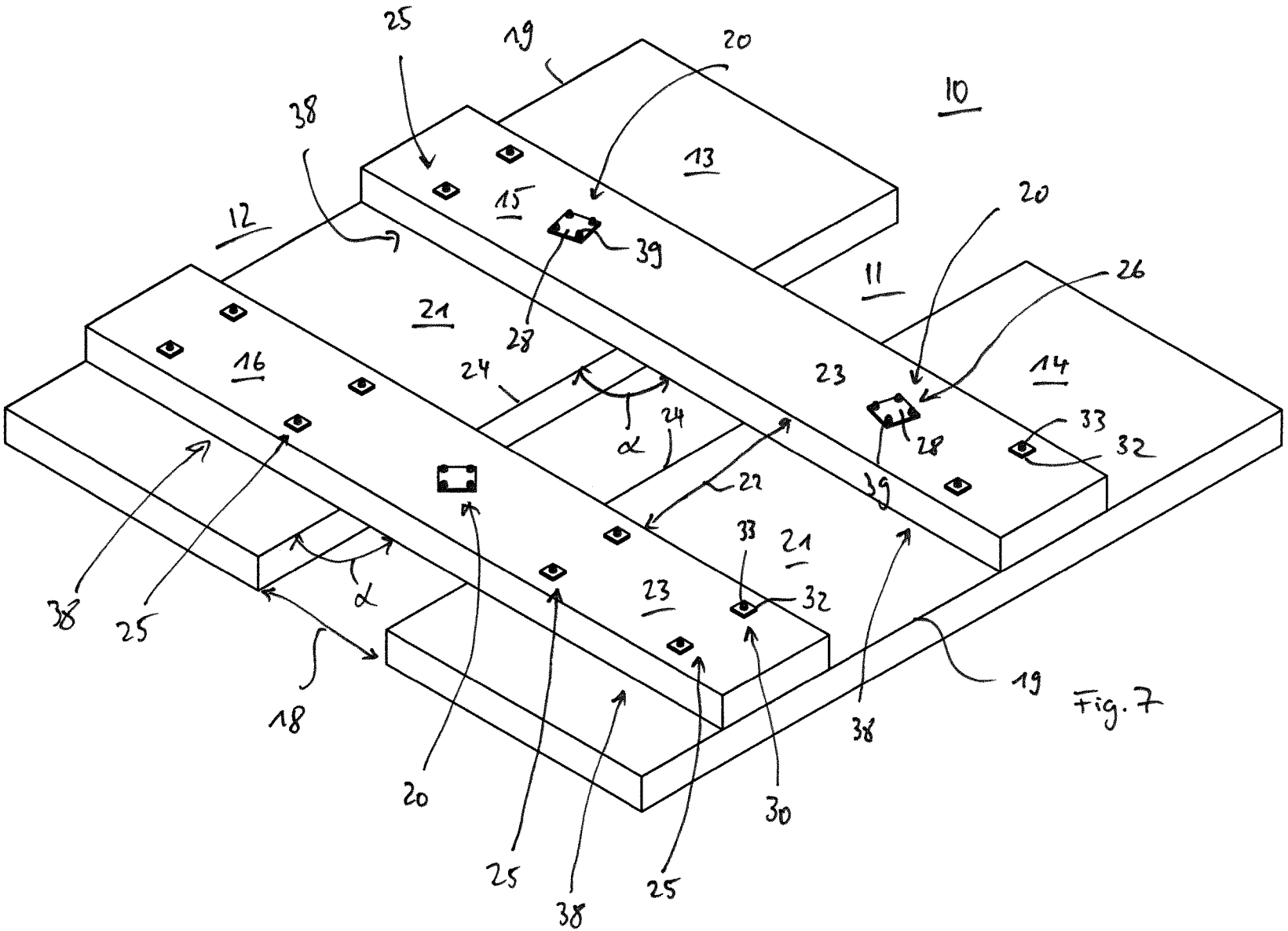
Figure 8:
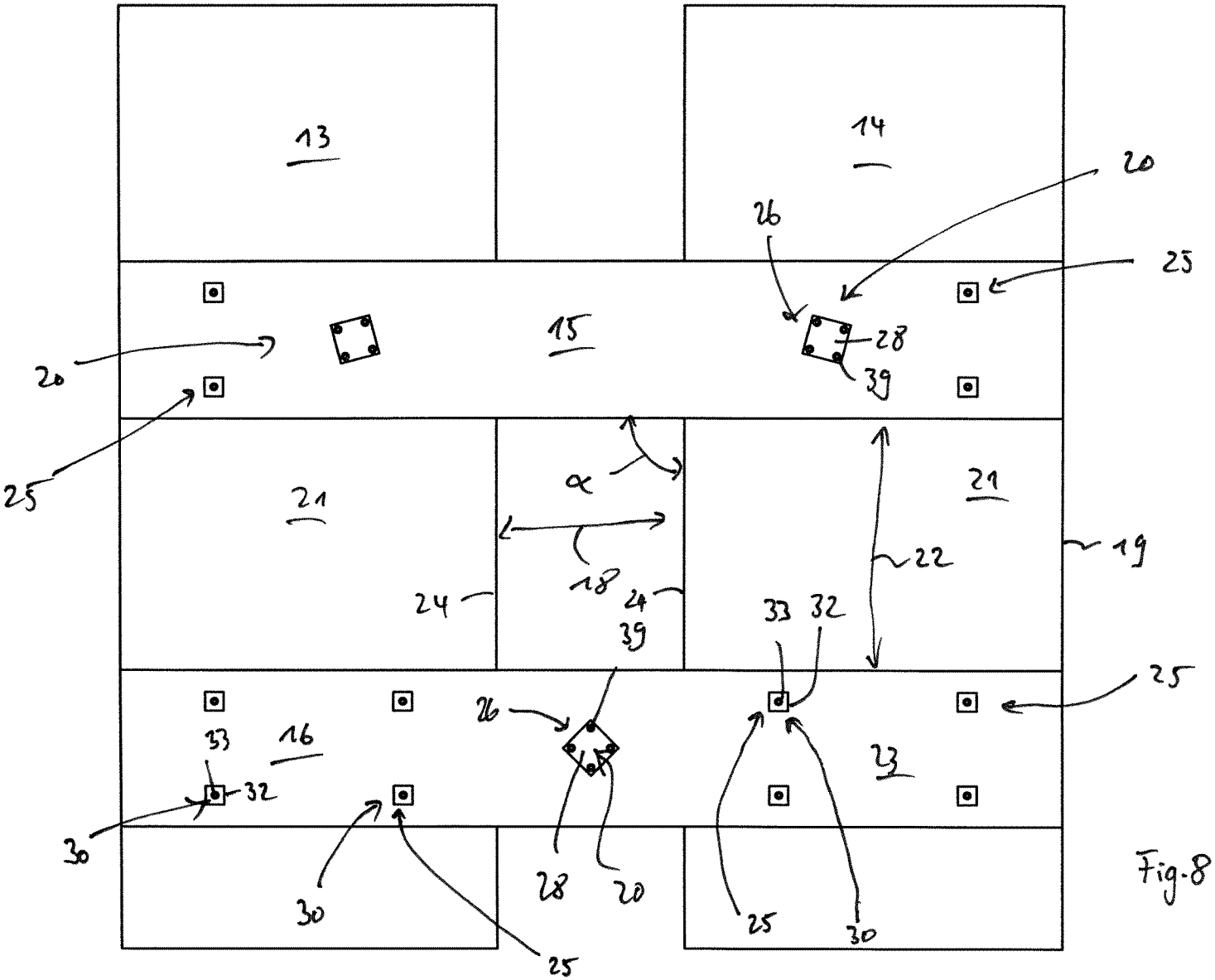
Figure 9:
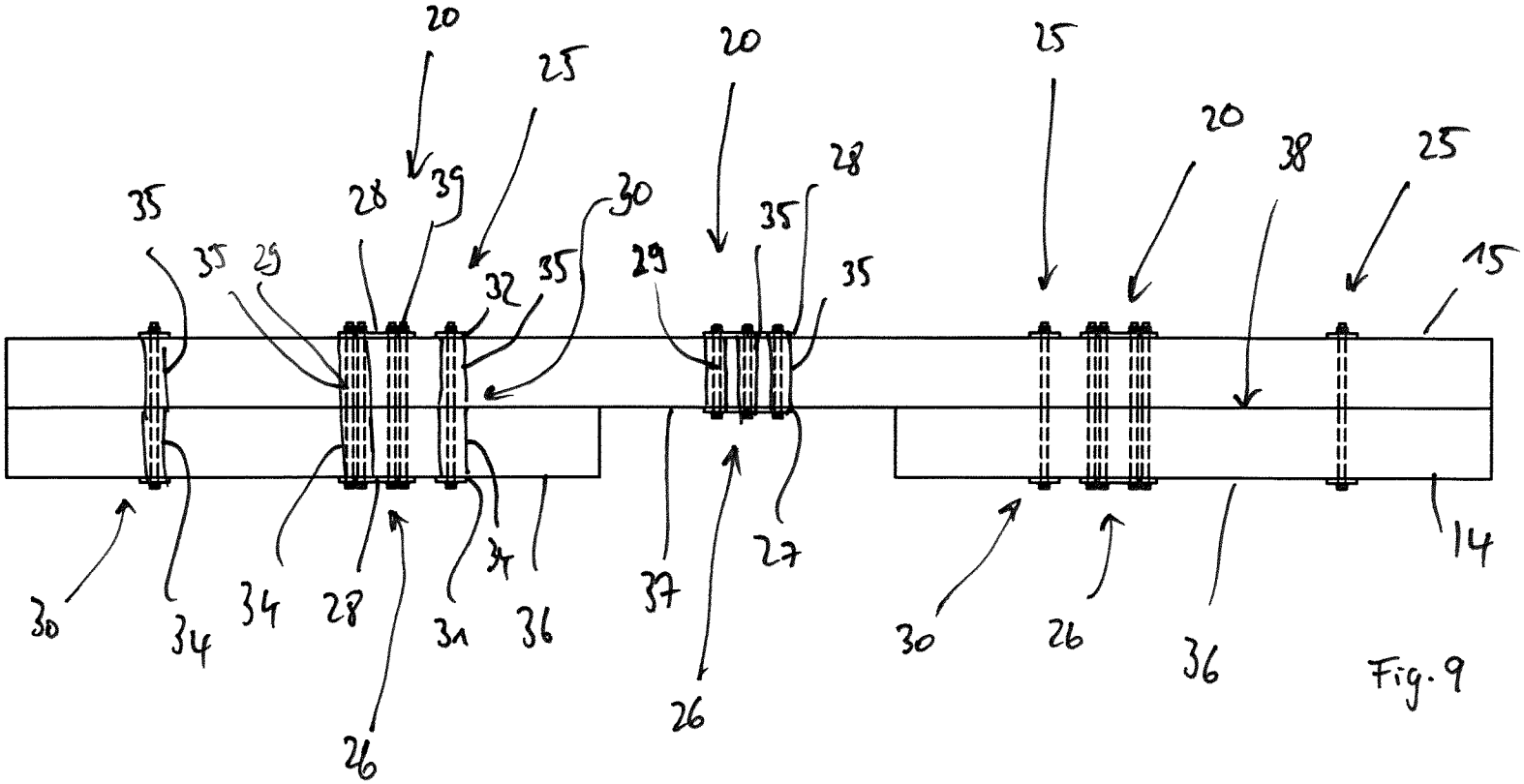
Figure 10:
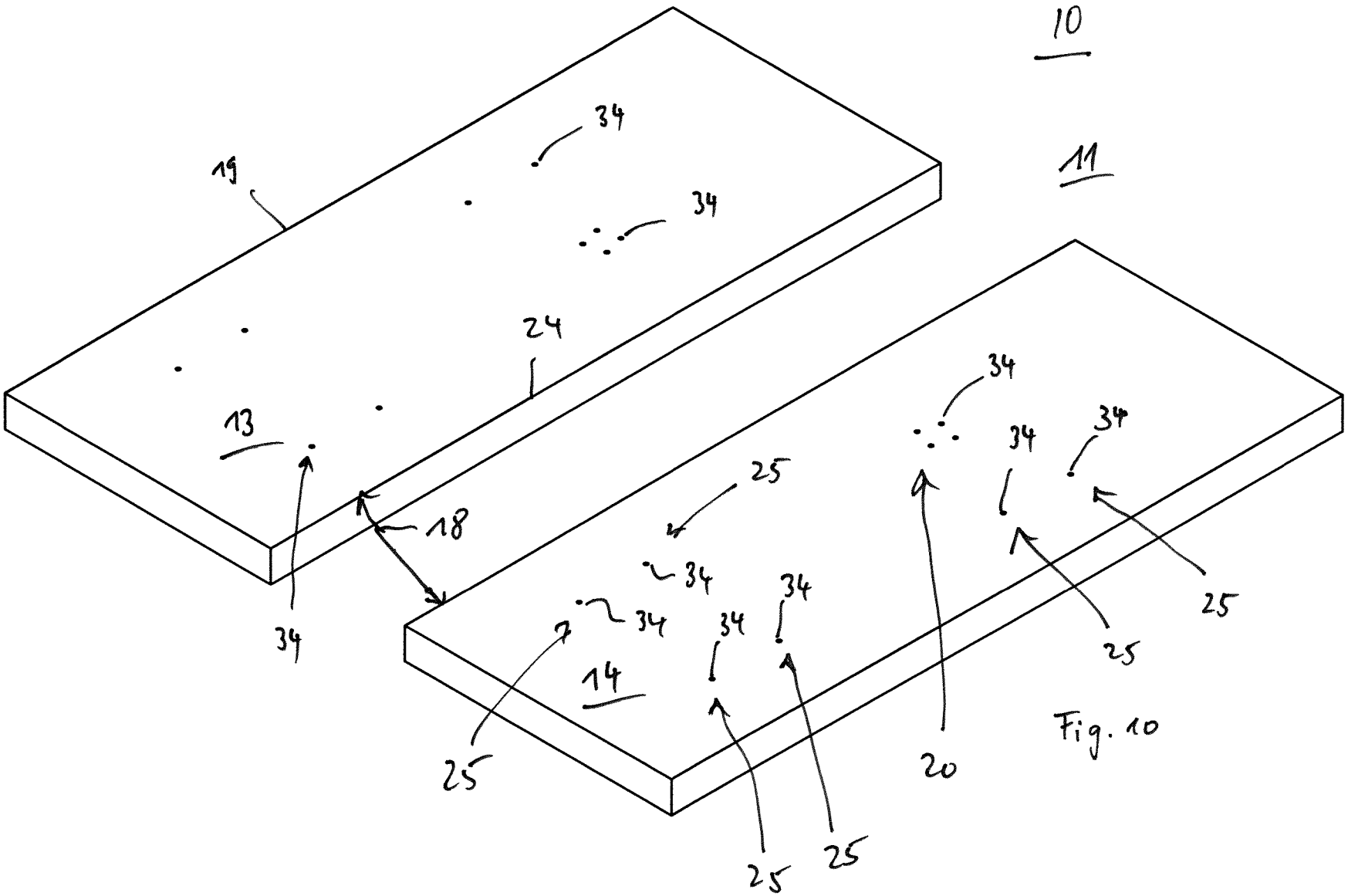
Figure 11:
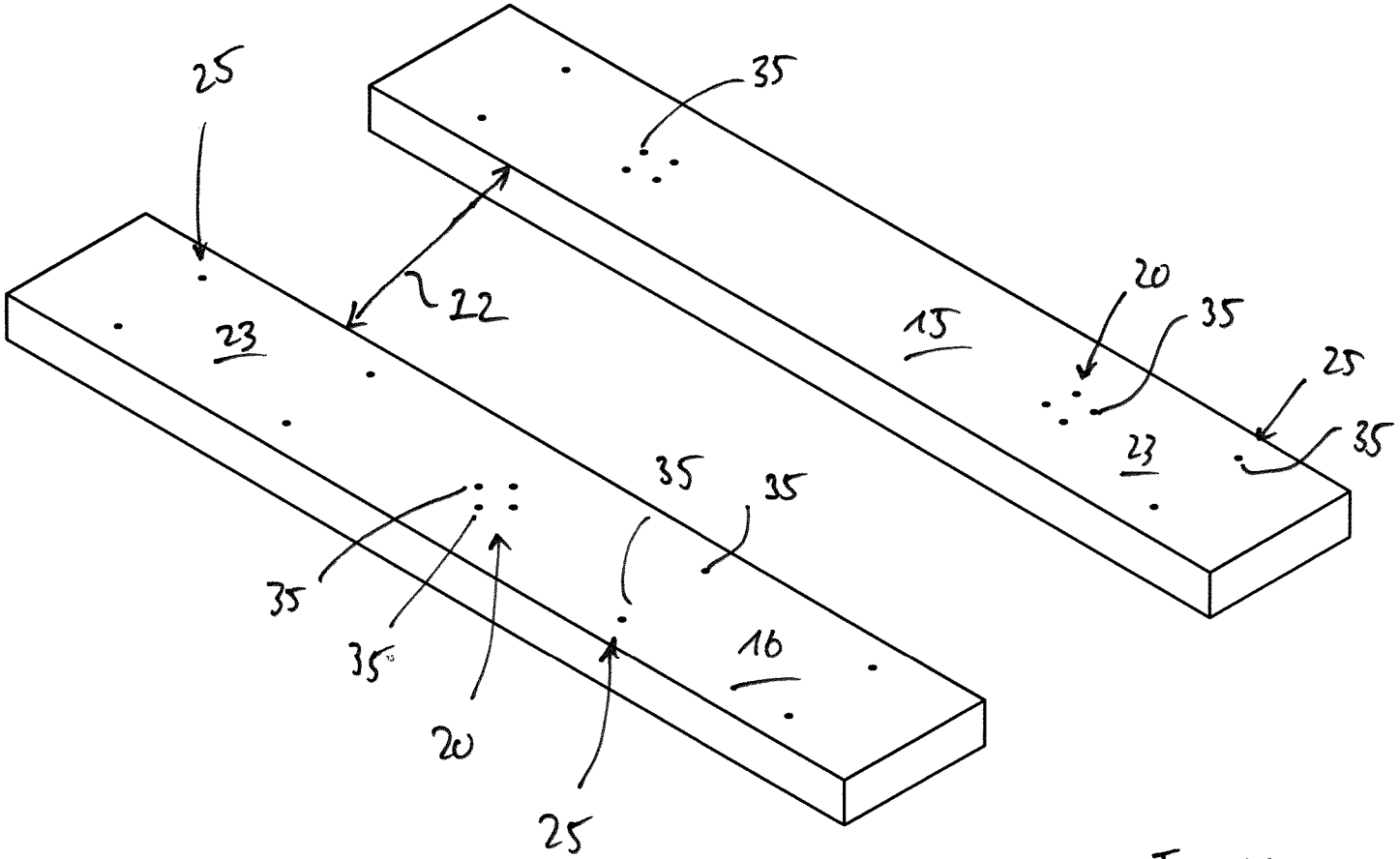
Figure 12:
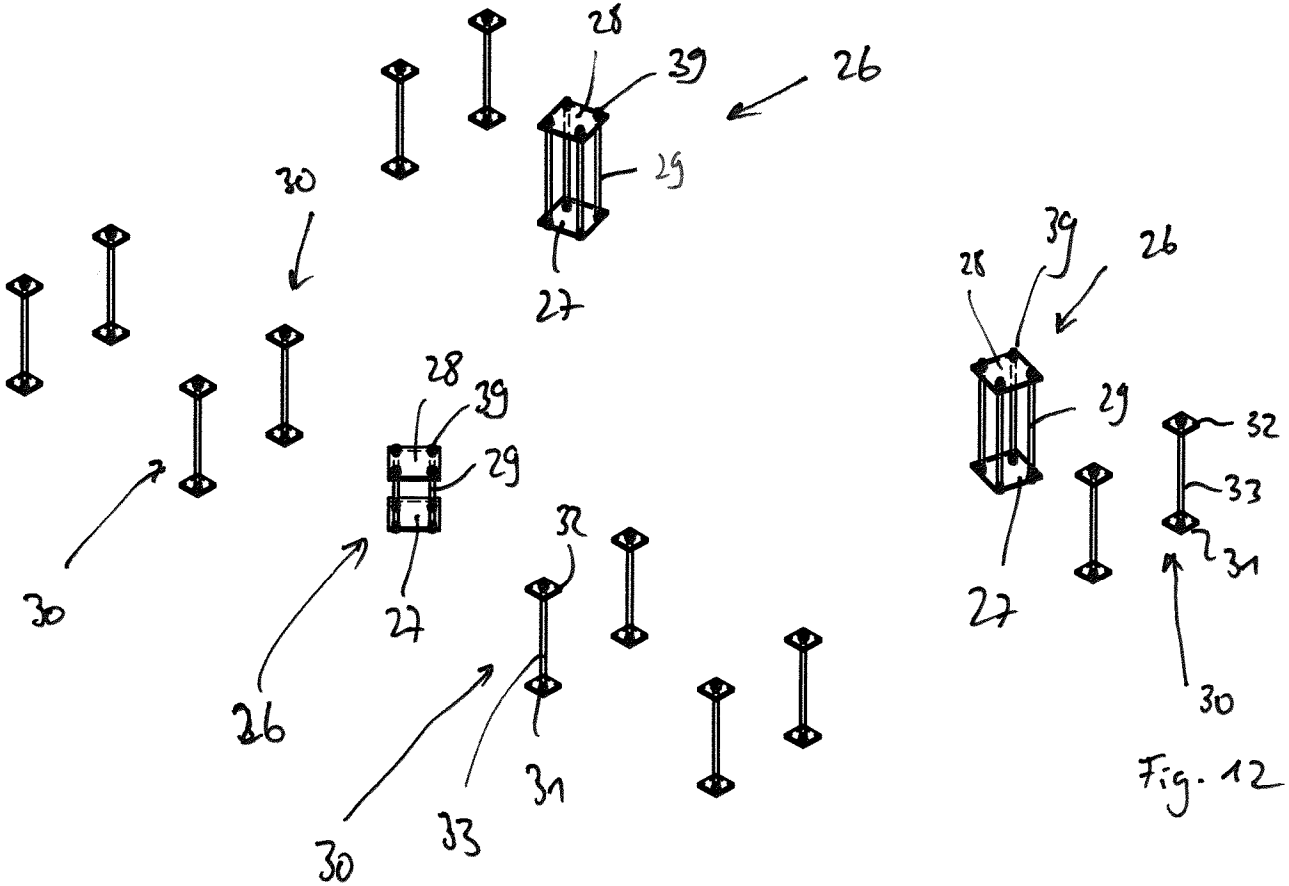
Figure 13:
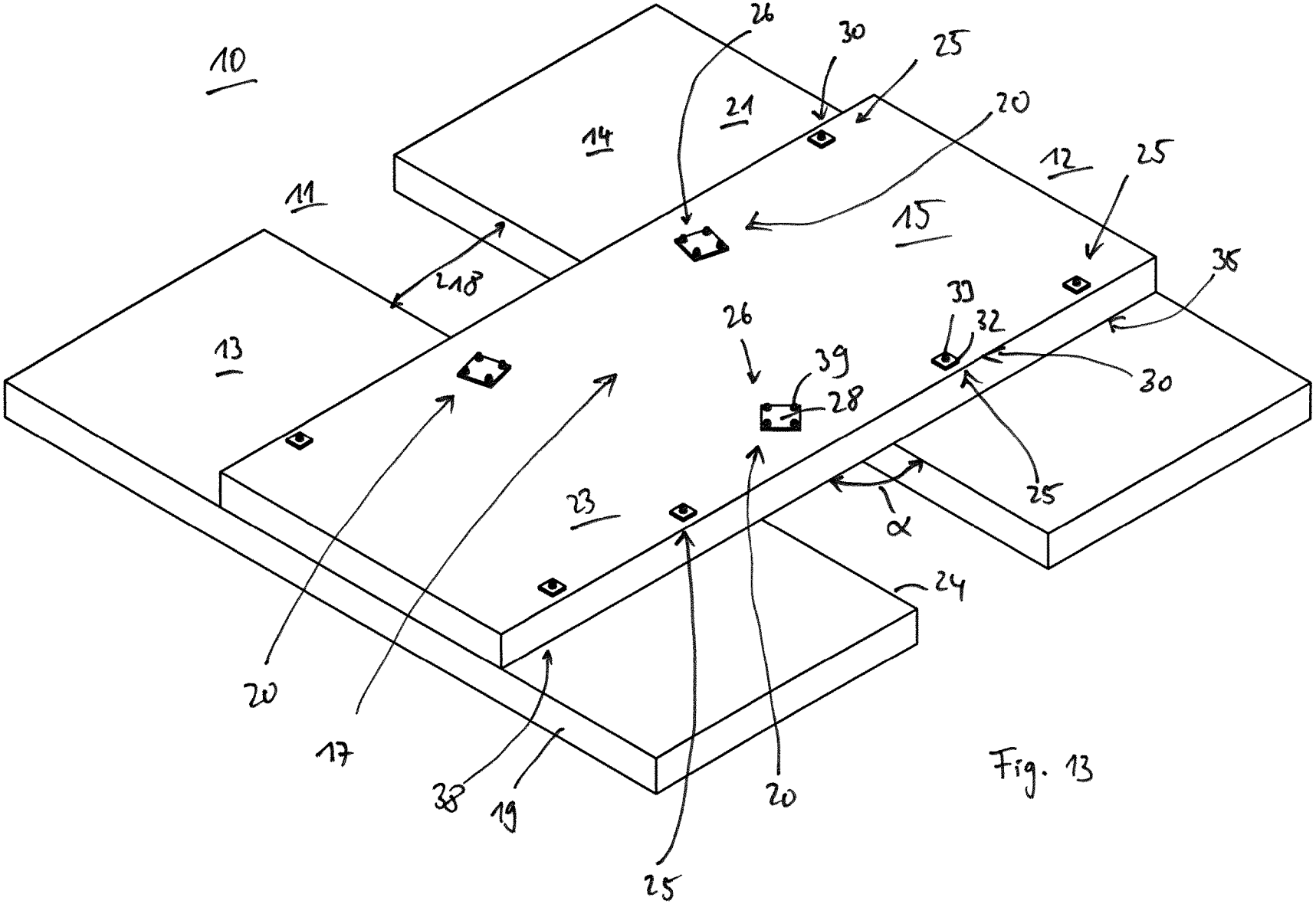
Figure 14:
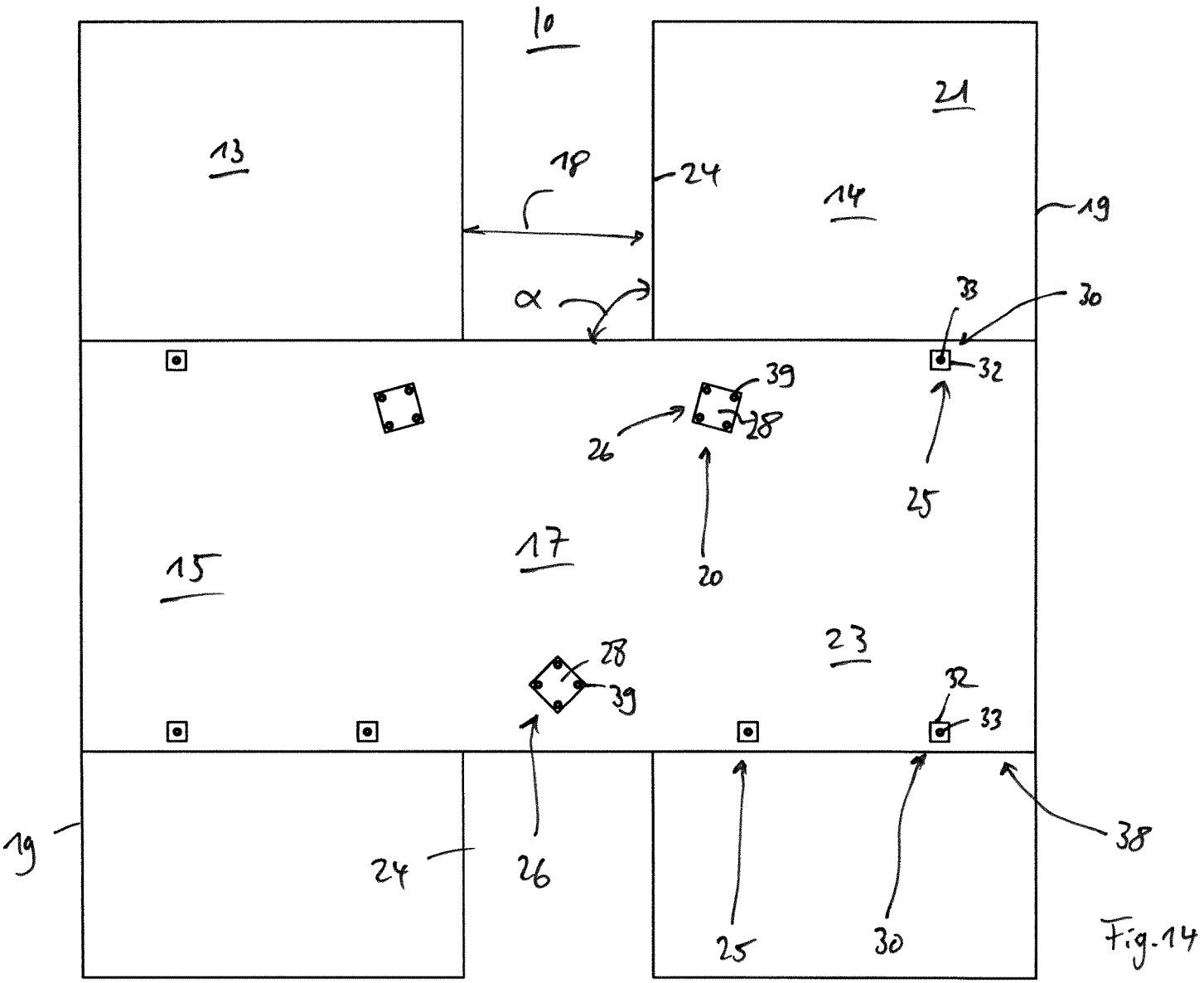
Figure 15:
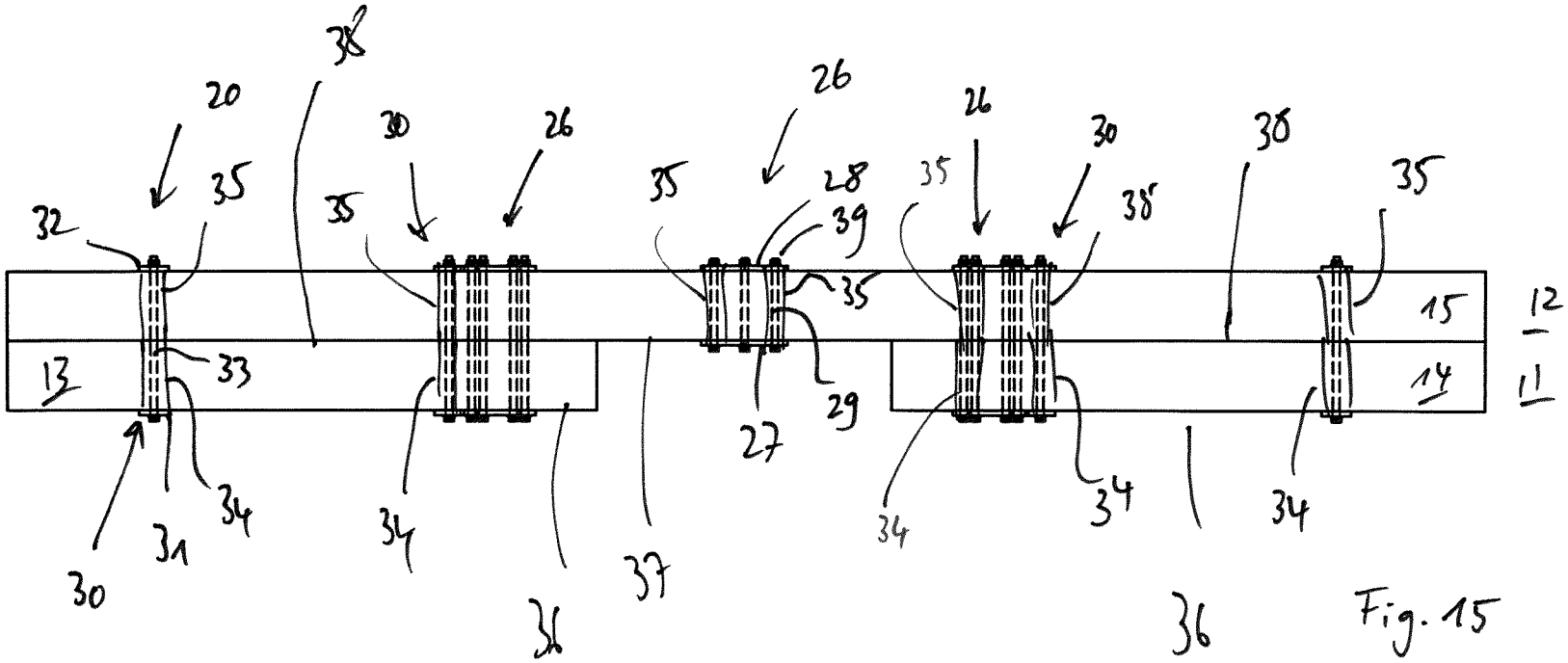
Figure 16:
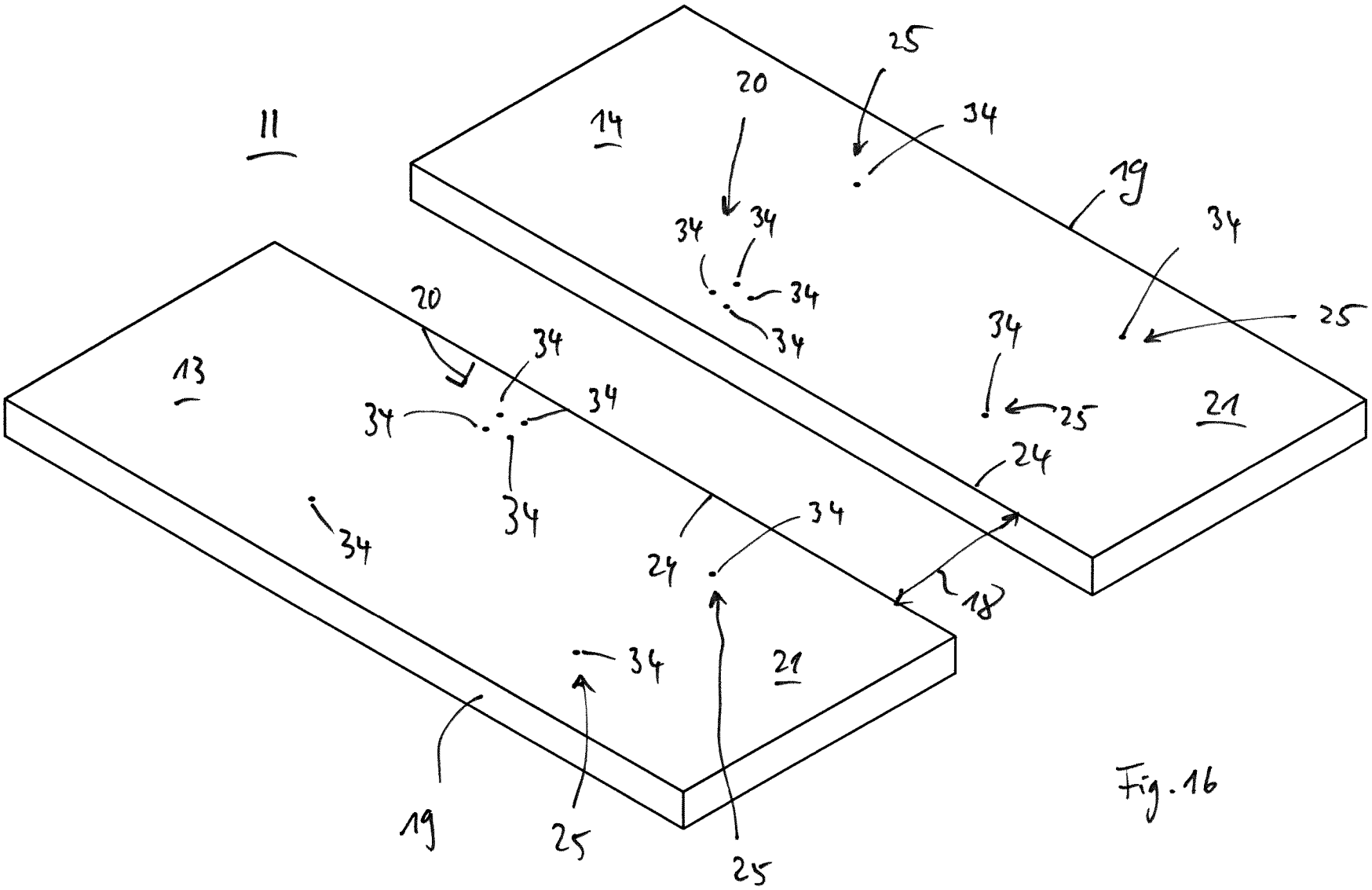
Figure 17:
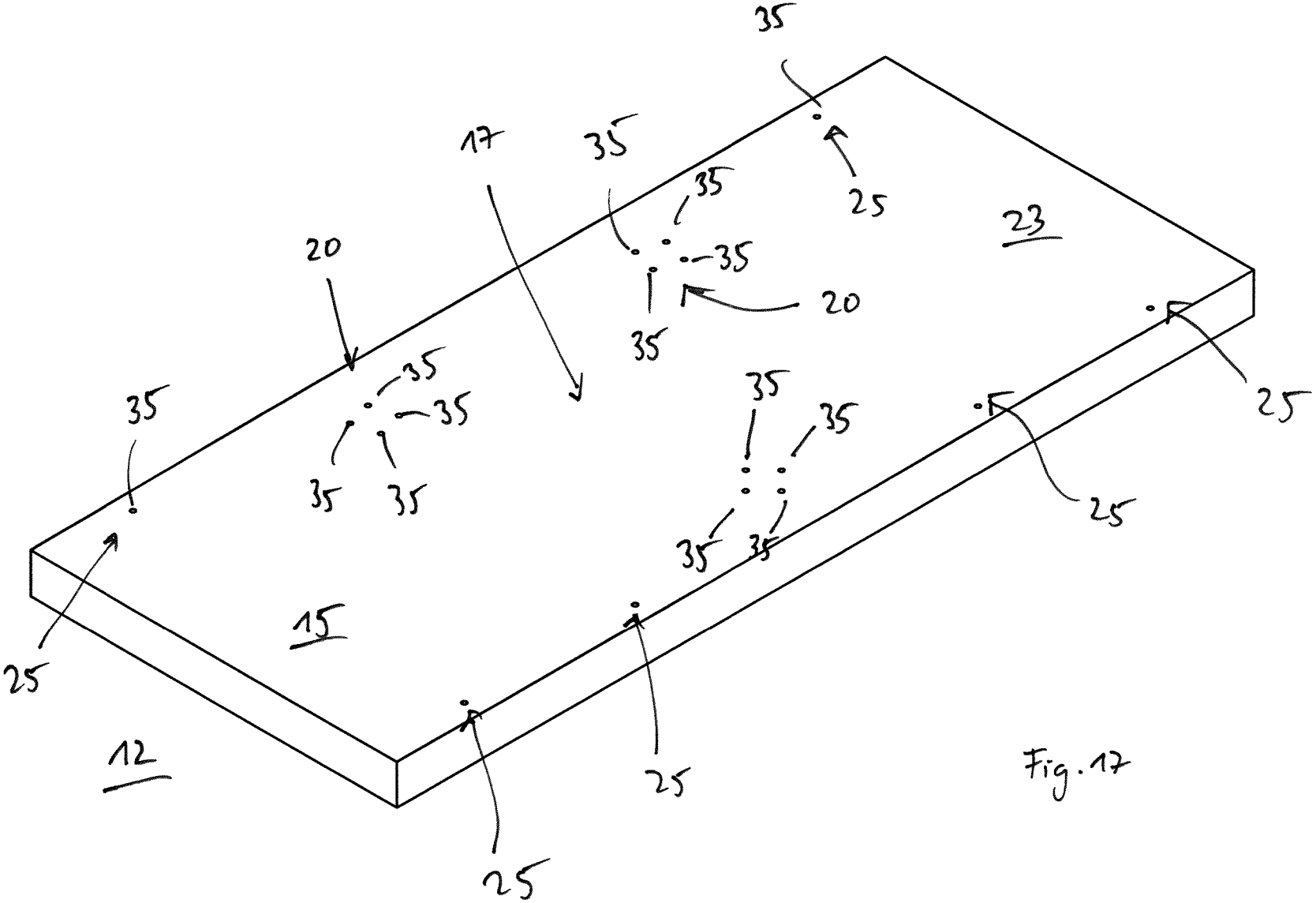
Figure 18:
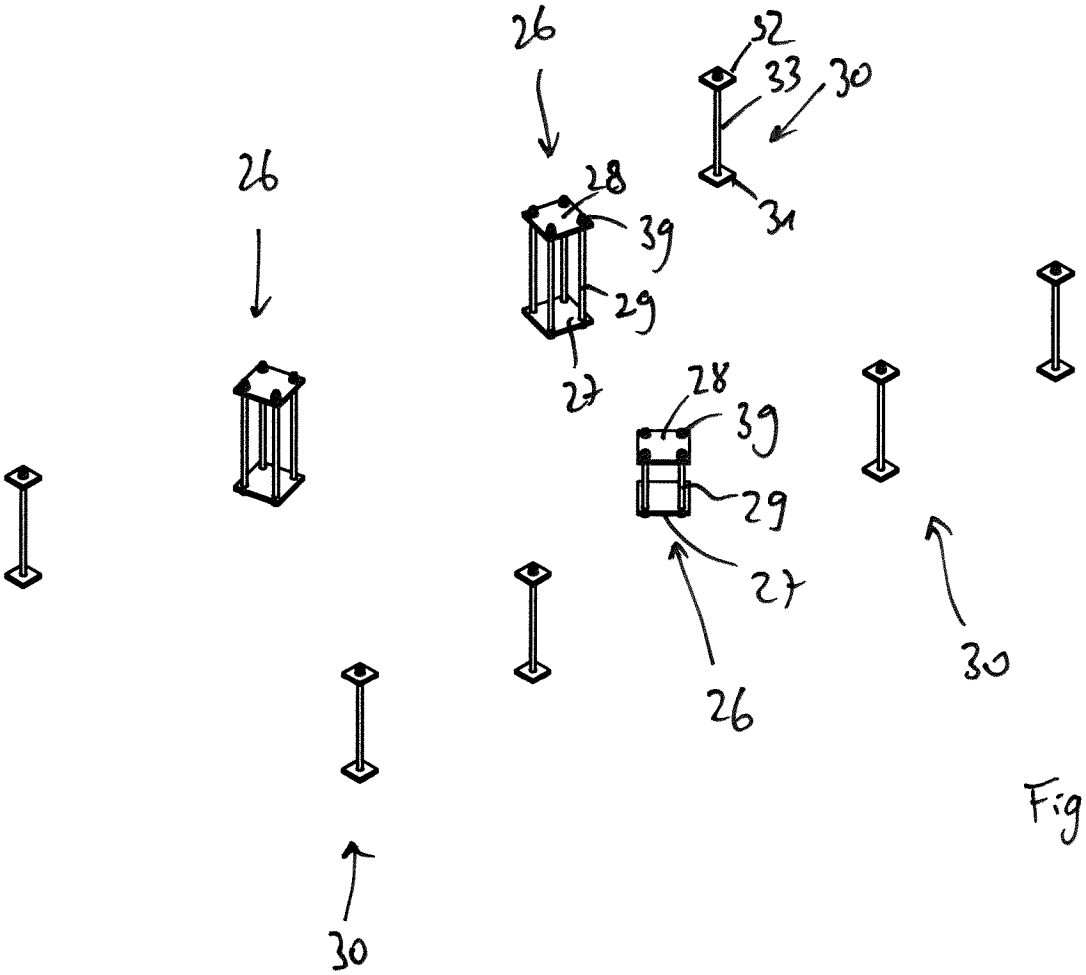
Figure 19:
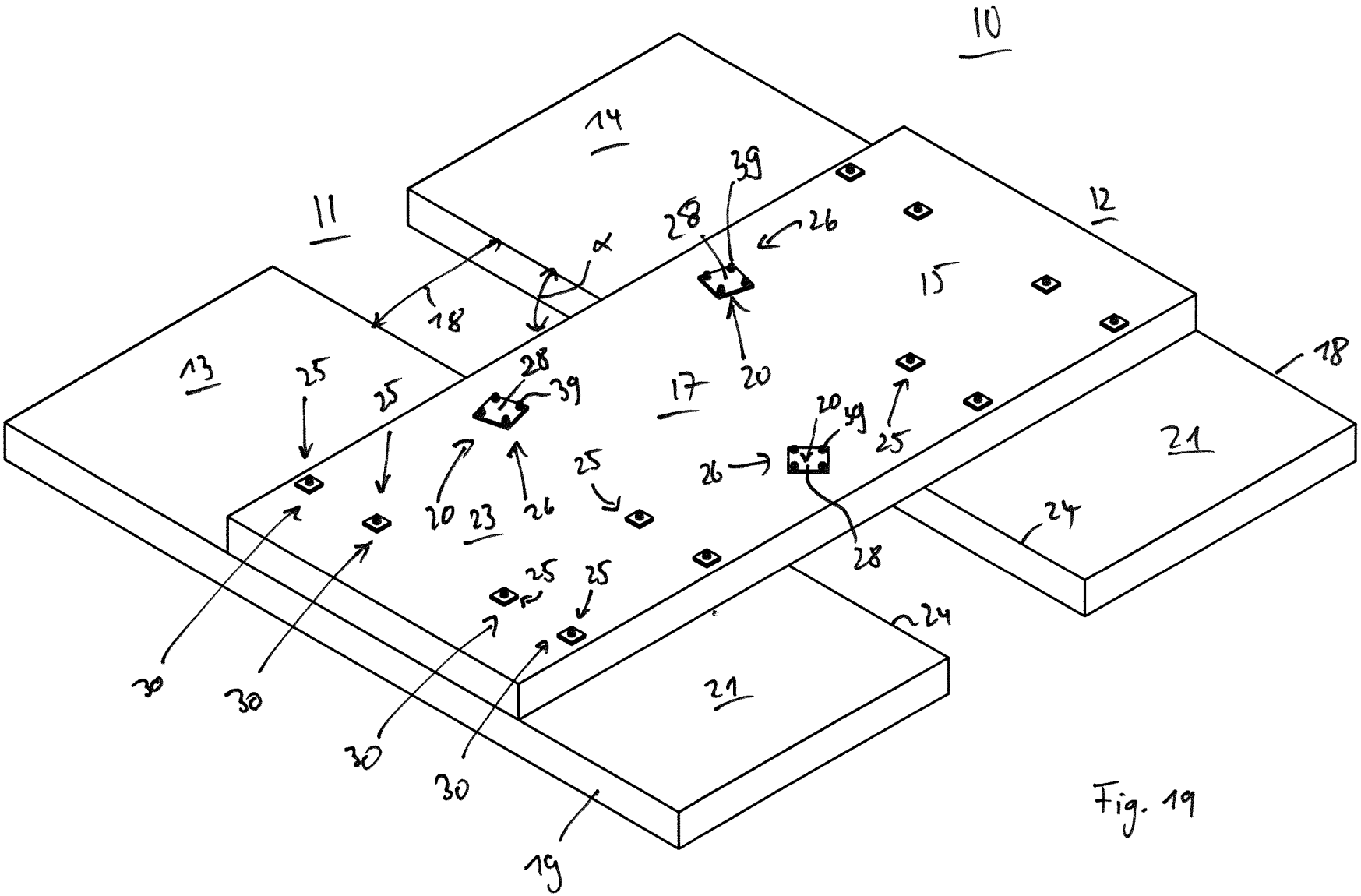
Figure 20:
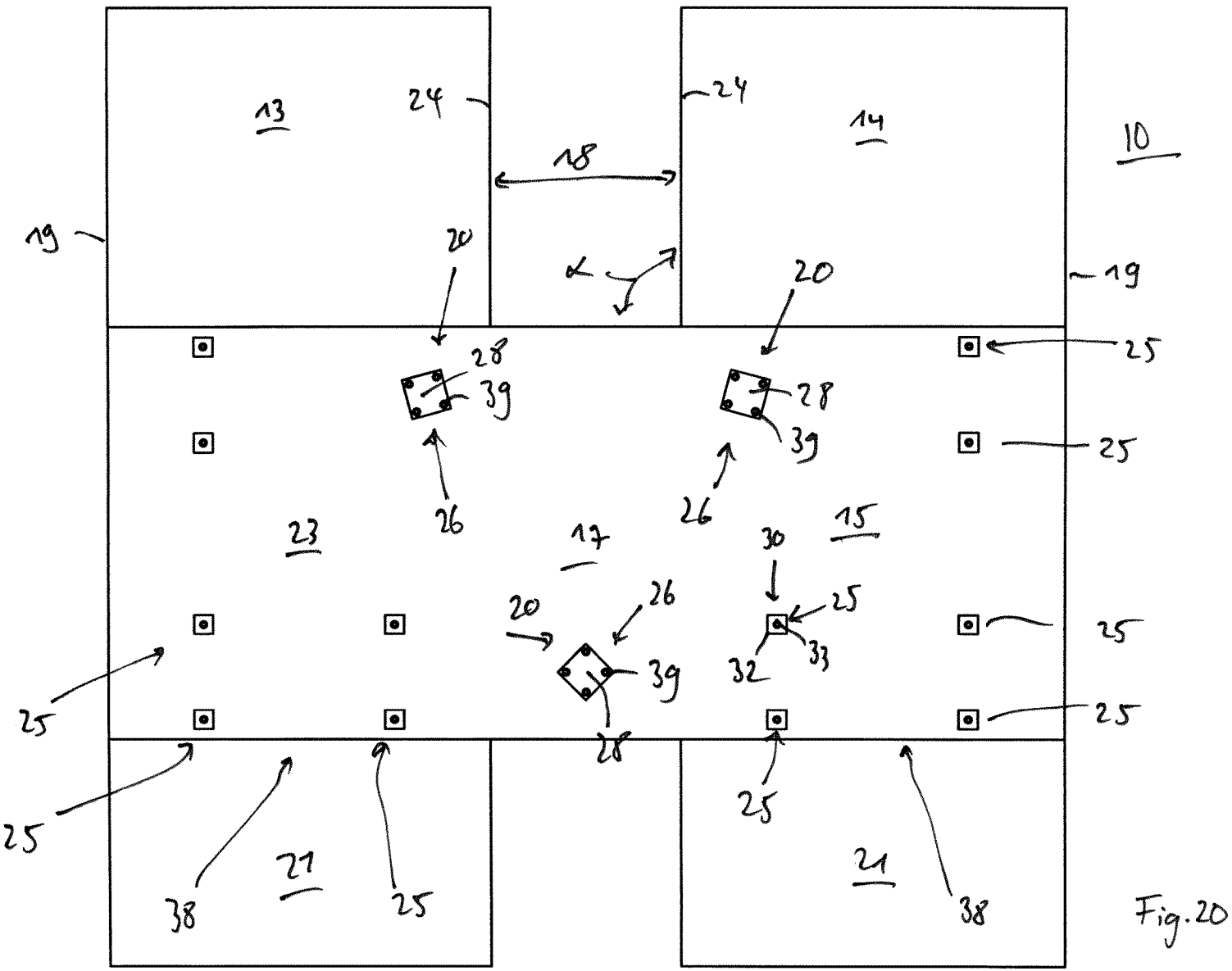
Figure 21:
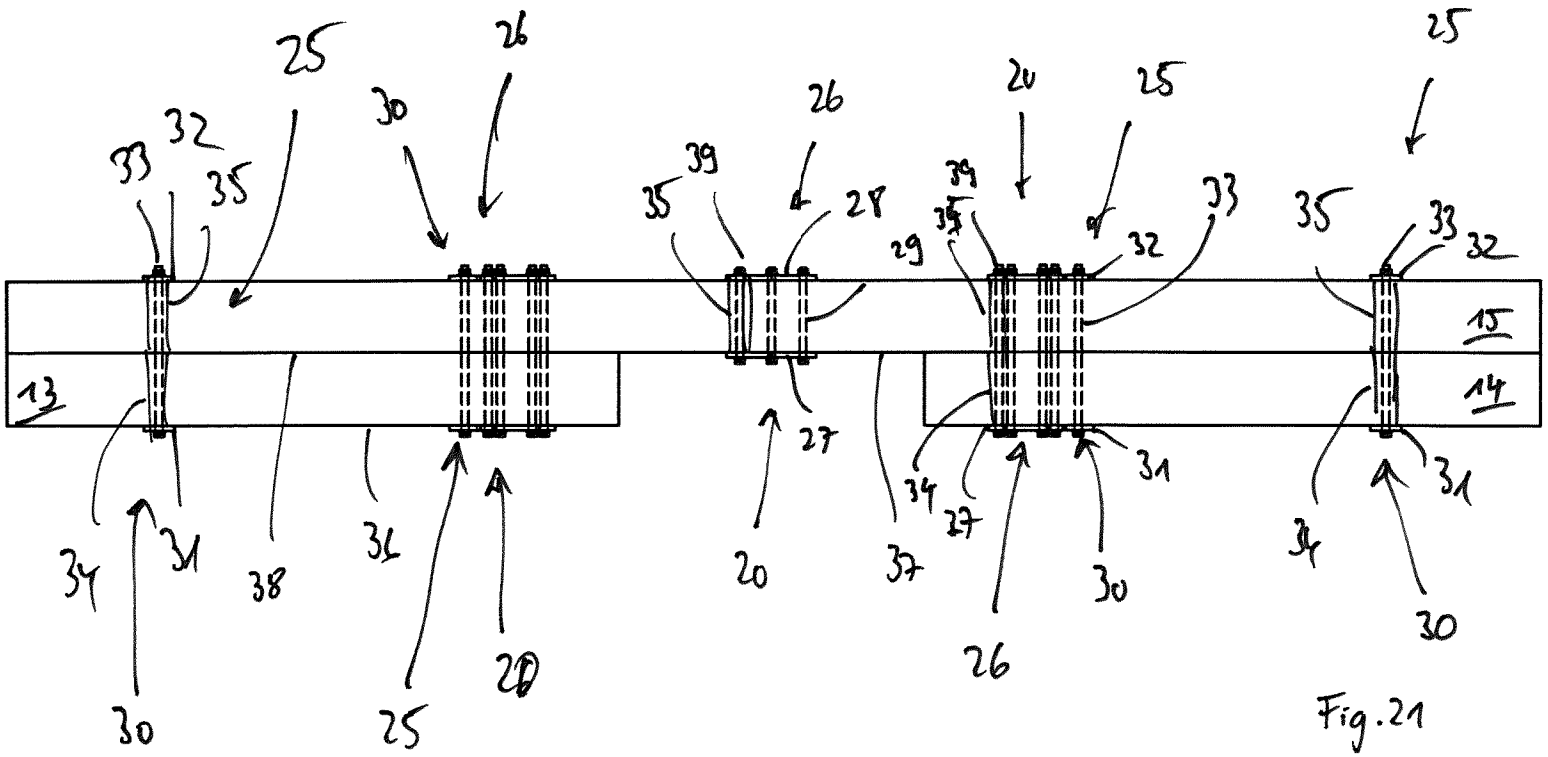
Figure 22:
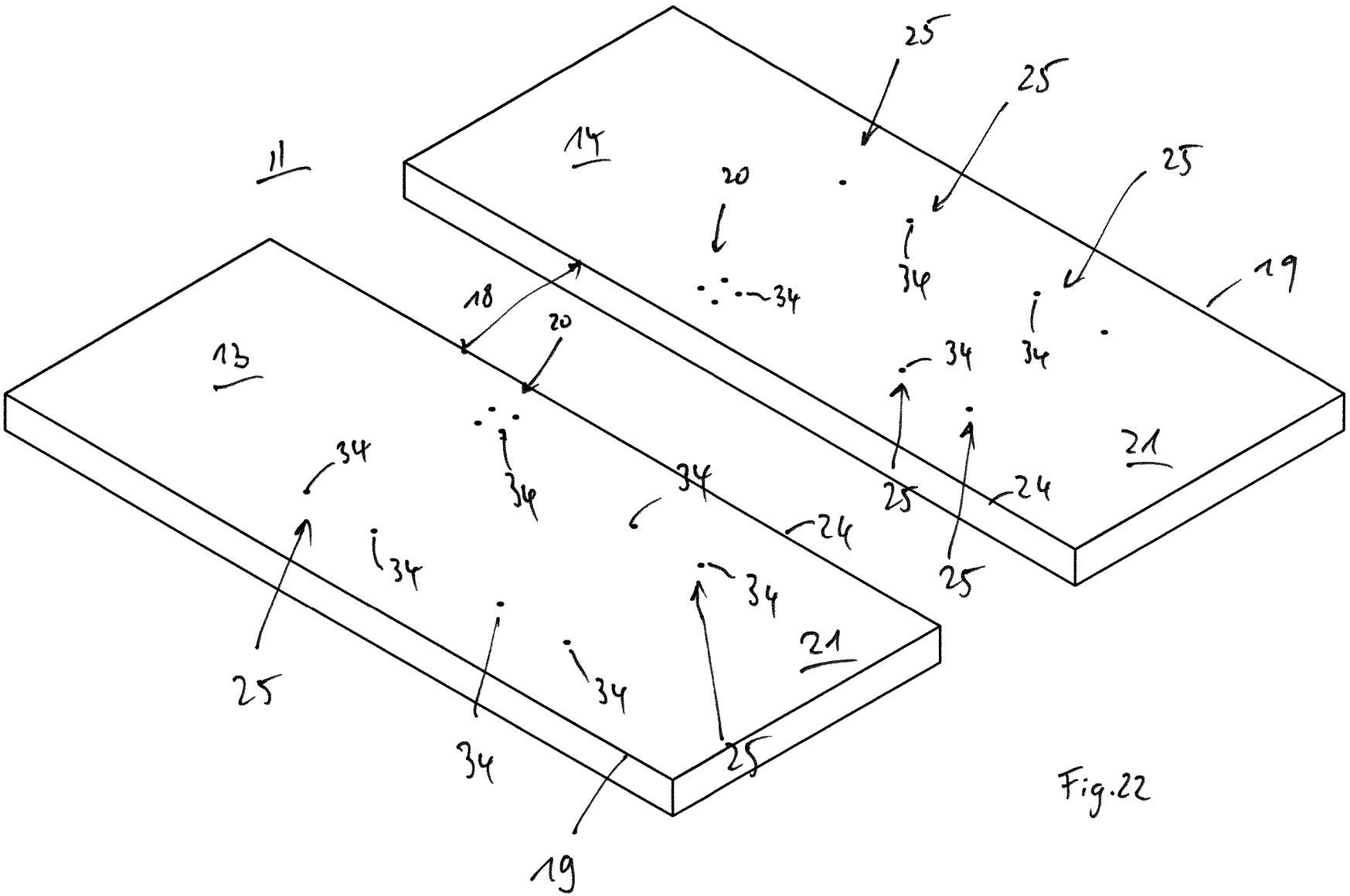
Figure 23:
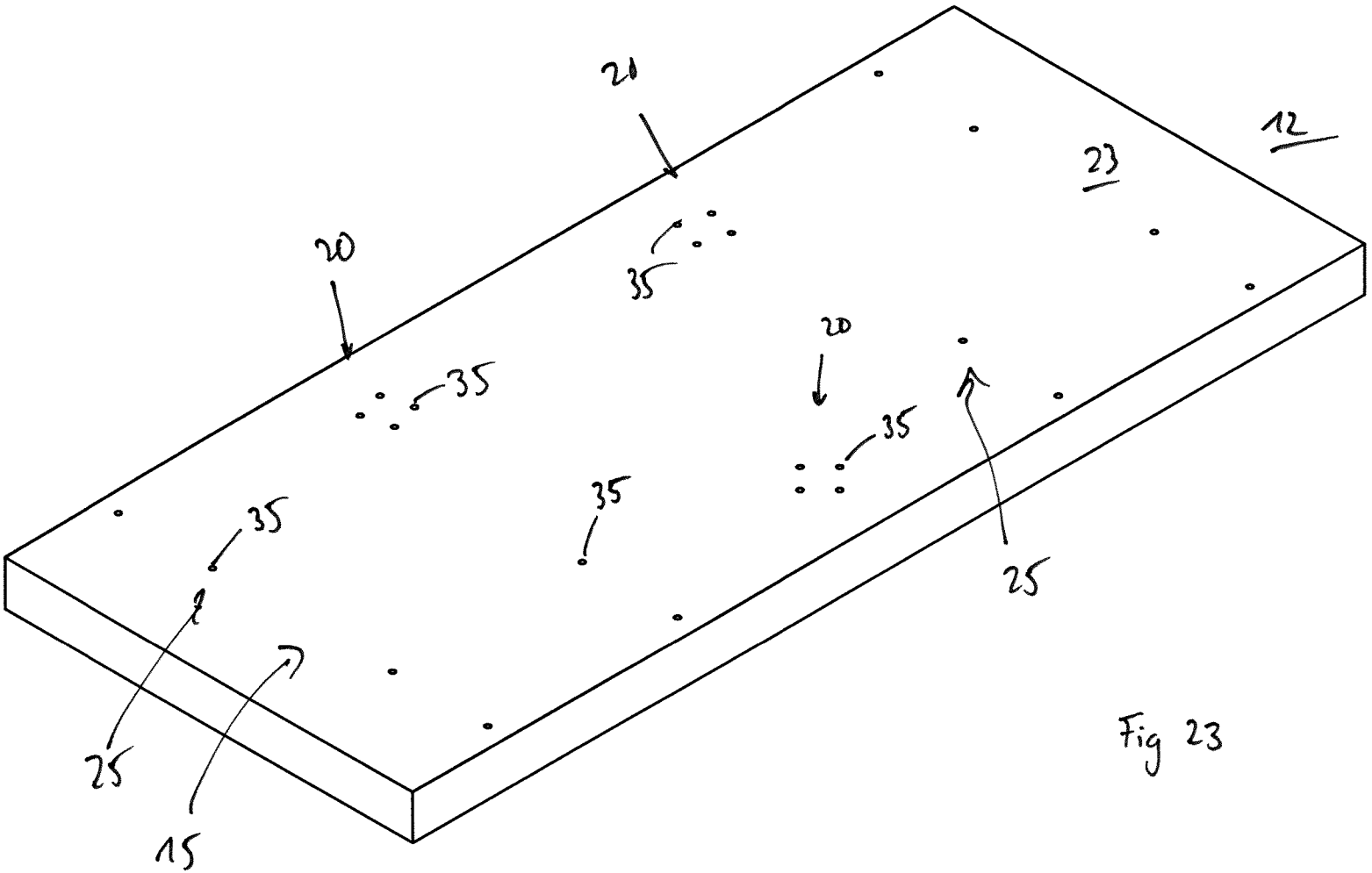
Figure 24:
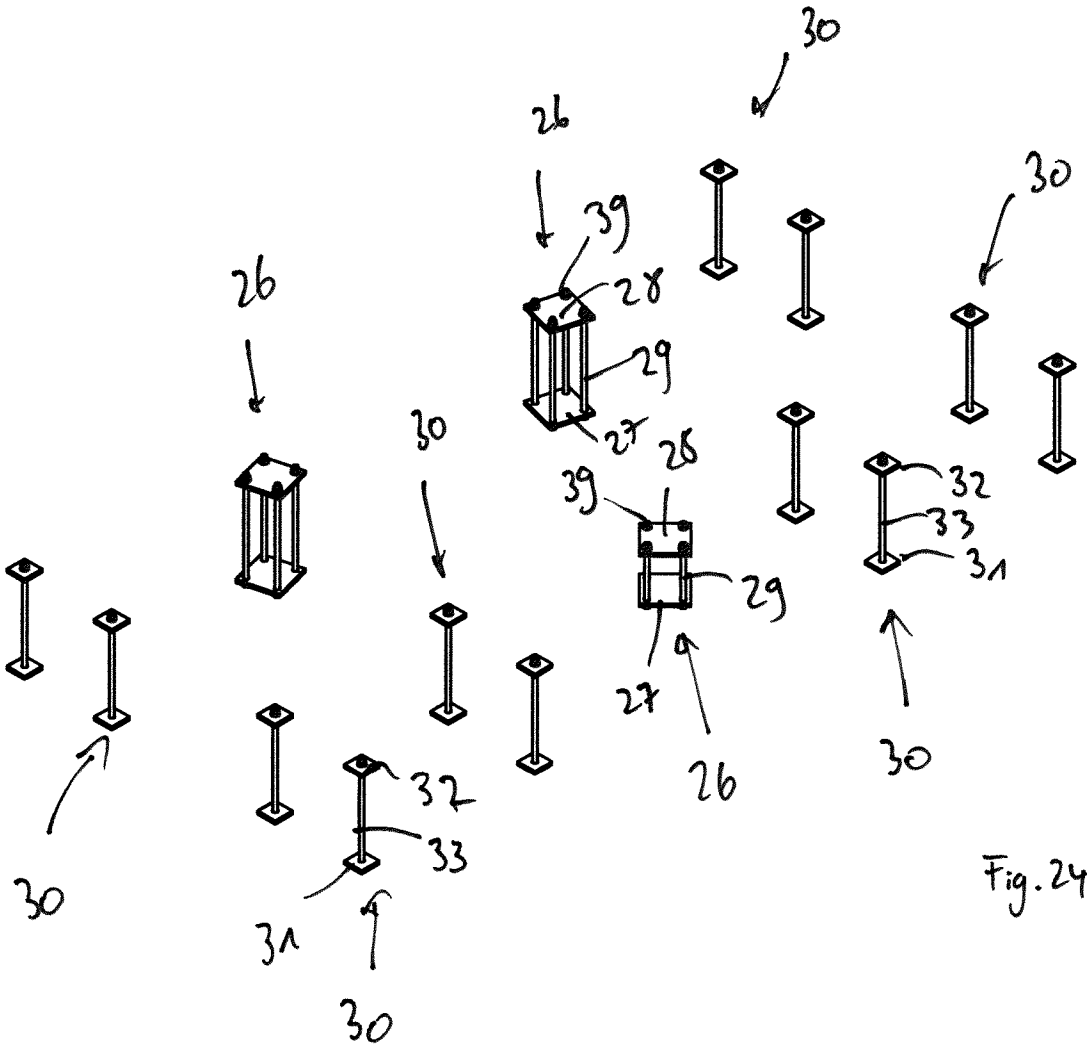
Figure 25:
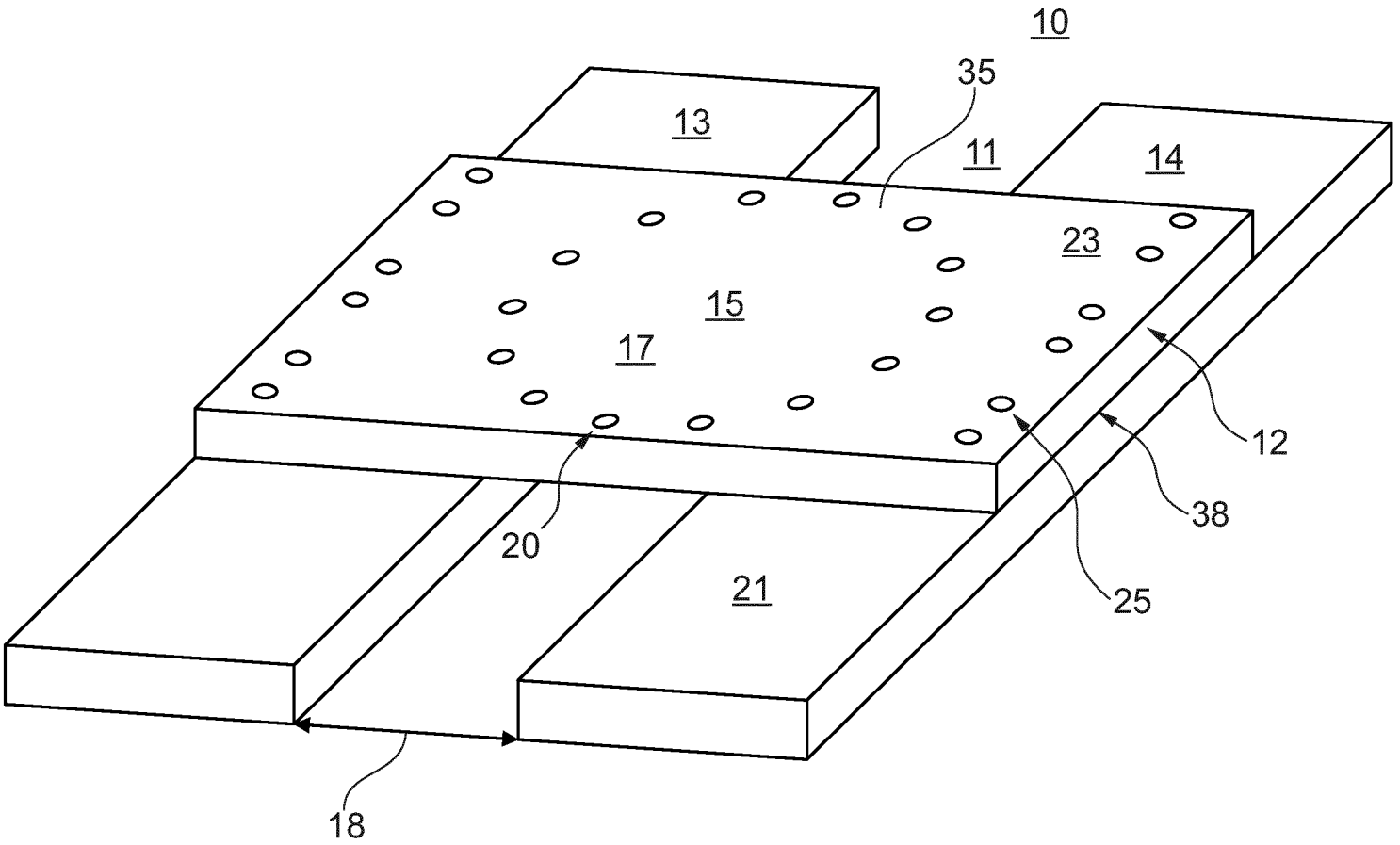

The invention is explained in more detail below using exemplary embodiments in conjunction with a drawing show:

FIG. 1 is a spatial view of a first embodiment of a foundation according to the invention, FIG. 2 is a plan view of FIG. 1, FIG. 3*a* is a side view of FIG. 1, FIG. 3*b* is an alternative side view to FIG. 1, FIG. 4*a* shows a three-dimensional view of the lower foundation section of FIG. 1, FIG. 4*b* is an alternative spatial view of the bottom foundation section to FIG. 1, FIG. 5*a* is a spatial view of the upper foundation section of FIG. 1, FIG. 5*b* shows an alternative three-dimensional view of the upper foundation section to FIG. 1, FIG. 6 shows a spatial representation of the fastening means for the FIGS. 3*a*, 4*a* and 5*a*, FIG. 7 shows a spatial view of a second embodiment of a foundation according to the invention, FIG. 8 is a plan view of FIG. 7, FIG. 9 is a side view of FIG. 7, FIG. 10 is a spatial view of the lower foundation section of FIG. 7, FIG. 11 is a spatial view of the upper foundation section for FIG. 7, FIG. 12 is a spatial representation of the fastening means FIG. 7, FIG. 13 is a three-dimensional view of a third embodiment of a foundation according to the invention, FIG. 14 is a plan view of FIG. 13, FIG. 15 is a side view of FIG. 13, FIG. 16 is a spatial view of the lower foundation section of FIG. 13, FIG. 17 is a spatial view of the upper foundation section of FIG. 13, FIG. 18 is a spatial representation of the fastening means FIG. 13, FIG. 19 is a spatial view of a fourth embodiment of a foundation according to the invention, FIG. 20 is a plan view of FIG. 19, FIG. 21 is a side view of FIG. 13, FIG. 22 is a spatial view of the lower foundation section of FIG. 19, FIG. 23 is a spatial view of the upper foundation section of FIG. 19, FIG. 24 is a spatial representation of the fasteners FIG. 19, and FIG. 25 is a spatial view of a fifth embodiment of a foundation according to the invention.

FIGS. 1 to 6 show a first embodiment of a foundation 10 according to the invention with a lower section 11 and an upper section 12 arranged above it. The lower section 11 is composed of a first element 13 and a second element 14 which are arranged parallel to one another at a distance 18.

A third element 15 and a fourth element 16 are arranged at an angle α, here preferably 90°, on the upper side of the first element 13 and the second element 14 to form the upper section 12. The third element 15 is arranged parallel to the fourth element 16 to form the upper section 12 with a spacing 22. A mounting area 17 is provided on the upper side 23 of the third element 15 and the fourth element 16. Here, for example, this has four attachment points 20 in order to erect a four-legged tower (not shown) thereon.

The length of the third element 15 and the fourth element 16 is chosen such that it corresponds to the width of the first element 13 and the width of the fourth element 14 and the distance 18 between the two in total. The third element 15 and the fourth element 16 thus extend between the outer edges 19 of the first element 13 and the second element 14.

The attachment points 20 in the assembly area 17 are provided according to the erection geometry of the tower to be straightened (not shown). In the exemplary embodiment shown, these are offset towards the inner edges 24 of the first element 13 of the second element 14.

In addition, connection points 25 are provided offset towards the outer edge 19 on the third element 15 and the fourth element 16. The number of connection points 25 is dependent on the loads to be removed from the tower to be erected on the foundation 10.

FIGS. 3*a*, 4*a*, 5*a* and 6 show a first embodiment for providing the attachment points 20 and the connection points 25. Anchor cage-like fastening elements 26 are provided at the fastening points 20. The fastening element 26 has a plate-shaped abutment 28 on its upper side and a plateshaped abutment 27 on its underside. Between the abutments 27, 28 clamping elements 29 are provided. The clamping element 29 protrudes from the upper abutments 28. The overhang forms the connecting sections 39 for connecting the tower. The clamping elements 29 can be threaded rods or other anchor rods, for example. In the exemplary embodiment shown here, the abutment elements 27, 28 of the fastening elements 26 are designed as square plates, which are each connected to four clamping elements 29. Alternative designs and in particular other numbers of clamping elements 29 are possible.

At the connection point 25 connection elements 30 are provided, which in turn also have a plate-like abutment 32 on the upper side and an abutment 31 on the underside, which in turn are connected to a tensioning element 33. In the embodiment shown here, the abutment elements 31, 32 of connecting elements 30 are designed as square plates, which are each connected to a clamping element 33. Alternative designs and in particular other numbers of clamping elements 33 are possible.

The first element 13 and the second element 14 have openings 34, as shown in FIG. 4*a*, in which the fastening elements 26 and connecting elements 30 are arranged. The same applies to the third element 15 and the fourth element 16 according to FIG. 5*a*, in which openings 35 are provided, in which the fastening elements 26 and connecting elements 30 are arranged. As shown in FIG. 3*a*, the openings 34, 35 are aligned in the assembled state.

For assembly, the abutments 31, 27 are provided on the underside 36 of the first element 13 and the second element 14. At the top of the third element 15 and the fourth element 16, the abutments 28, 32 are provided. In the openings 34, 35, the clamping elements 29 and the abutments 31, 32, the clamping elements 33 are provided between the abutments 27, 28. A part of the underside 37 of the third element 15 and the fourth element 16 rests on a corresponding part of the upper side 21 of the first element 13 and the second element 14. This creates an element joint 38 between the elements 13, 14, 15, 16. By clamping the elements using the fastening elements 26 at the fastening points 20 and the connecting elements 30 in the connection points 20 by generating a prestress between the abutments 27, 28 and 31, 32 by prestressing the clamping elements 29, 33, a shear connection is created between the elements 13, 14, 15, 16 provided, which is preferably carried out by a correspondingly strong bias so that in the fastening elements 26 and the connecting elements 30 there is no shearing stress. Due to the friction prevailing in the element joint 38 due to the prestressing, the loads caused by the tower in the foundation are correspondingly dissipated.

Alternatively, the bracing could also be designed in such a way that only a shear hole bearing connection is provided if the loads to be transferred are low.

FIGS. 3*b*, 4*b* and 5*b* show a second embodiment for providing the attachment points 20 and the connection points 25. Anchor cage-like fastening elements 26 are provided at the fastening points 20, as shown in FIG. 6. The fastening element 26 has a plate-shaped abutment 28 on its upper side and a plateshaped abutment 27 on its underside. Between the abutments 27, 28 clamping elements 29 are provided. The clamping element 29 protrudes from the upper abutments 28. The overhang forms the connecting sections 39 for connecting the tower. The clamping elements 29 can be threaded rods or other anchor rods, for example. In the exemplary embodiment shown here, the abutment elements 27, 28 of the fastening elements 26 are designed as square plates, which are each connected to four clamping elements 29. Alternative designs and in particular other numbers of clamping elements 29 are possible.

Connection elements 30 are provided at the connection point 25, as shown in FIG. 6. In the exemplary embodiment shown here, the abutment elements 31, 32 of the connecting elements 30 are designed as square plates, which are each connected to a clamping element 33. Alternative designs and in particular other numbers of clamping elements 33 are possible.

In contrast to the first embodiment, the first element 13 and the second element 14, as shown in FIGS. 3*b* and 4*b*, are installed in the production of the elements 13, 14 with the reinforcement and poured into the concrete. The third element 15 and the fourth element 16 have openings 35 according to FIG. 5*b*. During assembly, the openings 35 are slipped onto the clamping elements 29, 33 protruding from the elements 13, 14. The upper abutments 28, 32 are inserted into recesses 40, 41 on the top 23. The indentations can also be used in the first embodiment.

The prestressing clamping takes place as previously described.

FIGS. 7-12 show a second embodiment of a foundation 10 according to the invention, in which a third and fourth element 15, 16 are also arranged on a first and second element 13, 14. In contrast to the first embodiment, the second embodiment shows a foundation 10 for attaching a three-legged tower. Consequently, only three attachment points 20 are provided. Two attachment points are located, for example, on the third element 15 such that their attachment elements 26 are arranged in the openings 34, 35 and brace the third element 15 with the first element 13 and the second element 14, as was already shown in the first exemplary embodiment. The connection points 25 are also provided accordingly. Only the upper abutment 28 and the openings 34 and 35 corresponding thereto are correspondingly twisted to match the three-legged tower. The third attachment point 20, on the other hand, is only provided on the fourth element 16 above the distance 18 in order to achieve a triangular shape. Accordingly, the lower abutment 27 rests against the underside 37 of the fourth element 16. The clamping elements 29 are made correspondingly shorter. In order to bring about a corresponding connection between the fourth element 16 with the first element 13 and the second element 14, additional connection points 25 with corresponding connection elements 30 are provided. In addition to the ones on the outside Connection points 25 provided on the fourth element 16 are provided with further connection points 25 which are correspondingly shifted opposite one another towards the region of the distance 18. The connection elements 30 and the fastening elements 26 are constructed as shown in FIG. Here, too, it would be alternatively possible to partially provide the fastening elements 26 and connecting elements 25 by installing the abutments 27, 31 and the clamping elements 29, 33 in the first element 13 and the second element 14.

FIGS. 13-18, which show a third embodiment, and FIGS. 19-24, which show a fourth embodiment, represent a modification that instead of a narrow third and a narrow fourth element 15, 16, only a third element 13 is provided, but that has a greater width. The width is selected in such a way that the mounting area 17 can be arranged completely on the third element 15. The third and the fourth exemplary embodiment again show the arrangement of a three-legged tower. However, the exemplary embodiments are also suitable for four-legged or multi-legged towers. This embodiment is also suitable for a round tower, as shown in FIG. 25 as a further embodiment. The third and the fourth embodiment differ here only in the number of connection points 25. The third attachment point 20 is also again in the area of the distance 18 so that it does not contribute to the connection of the third element 15 to the first element 13 and the second element 14. The rest of the structure corresponds to the versions described above.

FIG. 25 shows an embodiment in which a round tower is arranged on the mounting area 17 on the upper section 12 in the form of a third element 15. FIG.

496 In this case, openings 35 are provided in the third element 15, which are provided partially in the region of the distance 18 and partially above the first and second element 13, 14. In this case, an anchor cage is used as a fastening element 26 (not shown), which is provided in divided form for assembly. Sections of the anchor cage are provided on the underside 37 of the third element 15 and further sections on the underside 36 of the first and second elements 13,14 (each not shown), which are then arranged in openings 34 and 35 analogous to what was previously disclosed. Depending on the size, an upper abutment 28 divided into several parts or a one-piece abutment 28 can be provided on the upper side. Connection points 25 are provided again analogous on the outer sides of the third element 15. Here again, recesses 40, 41 can be used.

The invention claimed is:

1. Foundation for a tower for a transmission station or the construction of overhead lines, comprising;

an assembly area for erecting the tower, with at least one first and at least one second prefabricated element, each made of reinforced concrete, forming a lower section;

at least one third prefabricated element, made of reinforced concrete, forming an upper section arranged on the lower section; wherein, a mounting area has at least one attachment point for arranging the tower on the foundation, the attachment point disposed on a top side of the upper section;

the at least one first prefabricated element and the at least one second prefabricated element of the lower section are parallel, with outer and inner edges a width apart with the inner edges of the at least one first and second prefabricated elements spaced apart by a distance;

the at least one third prefabricated element of the upper section is disposed on the at least one first prefabricated element and on the at least one second prefabricated element, whereby the at least one third prefabricated element bridges the distance, and;

the at least one third prefabricated element has a length, which corresponds to a total distance of the width of the at least one first prefabricated element, the width of the at least one second prefabricated element, and the distance between the at least one second and the at least one first prefabricated elements, whereby the at least one third prefabricated element is mounted to extend between the outer edges of the at least one first and second prefabricated elements.

2. The foundation according to claim 1, wherein the at least one attachment point of the mounting area comprises at least one opening with a vertical extension through the at least one third prefabricated element for inserting at least one fastening element.

3. The foundation according to claim 1, comprises at least one connection point for connecting the upper section to the lower section, and the at least one connection point comprises a breakthrough of vertical extension through at least one prefabricated element for inserting at least one fastening element.

4. The foundation according to claim 3, wherein the at least one fastening element provides a prestress in an element joint between the upper section and the lower section.

5. The foundation according to claim 2, wherein the at least one fastening element provides a tension in an element joint between the upper section and the lower section, the tension providing a shear hole bearing connection.

6. The foundation according to claim 1, wherein the at least three prefabricated elements comprise at least one of plate or cuboid shapes.

7. The foundation according to claim 1, wherein the at least one third prefabricated element is at right angles to the at least one first and to the at least one second element.

8. The foundation according to claim 2, wherein the at least one fastening element is at least one of an anchor cage, vertical bracing elements, prestressing elements, reinforcement elements, anchor elements, or threaded rods.

9. The foundation according to claim 3, wherein the at least one fastening element is at least one of an anchor cage, vertical bracing elements, prestressing elements, reinforcement elements, anchor elements, or threaded rods.

10. The foundation according to claim 4, comprising a shear connection in the element joint.

11. The foundation according to claim 1, wherein the at least one third prefabricated element comprises one third prefabricated element and one fourth prefabricated element in the upper section.

12. The foundation according to claim 11, wherein the third prefabricated element and the fourth prefabricated element are parallel and spaced apart from each other.

* * * * *